US007913960B1

(12) United States Patent
Herr, III et al.

(10) Patent No.: US 7,913,960 B1
(45) Date of Patent: Mar. 29, 2011

(54) BRACKETING SYSTEM

(75) Inventors: Charles W. Herr, III, Columbus, OH (US); Timothy C. Rothwell, Dublin, OH (US); Steve E. Pever, Bellefontaine, OH (US)

(73) Assignee: The Crane Group Companies Limited, Columbus, OH (US)

( * ) Notice: Subject to any disclaimer, the term of this patent is extended or adjusted under 35 U.S.C. 154(b) by 679 days.

(21) Appl. No.: 11/843,646

(22) Filed: Aug. 22, 2007

(51) Int. Cl.
*A47B 96/06* (2006.01)
*E05D 7/00* (2006.01)

(52) U.S. Cl. ..... 248/205.1; 248/288.11; 248/289.11; 248/240; 16/221; 16/266

(58) Field of Classification Search ..... 248/205.1, 248/288.11, 289.11, 240, 213.1; 16/260, 16/271, 254, 221, 266, 342, 343, 347; 211/96
See application file for complete search history.

(56) References Cited

U.S. PATENT DOCUMENTS

| | | | | |
|---|---|---|---|---|
| 1,087,576 | A * | 2/1914 | Fernald | 16/259 |
| 3,944,178 | A * | 3/1976 | Greenwood | 248/231.61 |
| 4,101,050 | A | 7/1978 | Buckler et al. | |
| 4,523,735 | A * | 6/1985 | Beck et al. | 248/476 |
| 4,744,930 | A | 5/1988 | Twist et al. | |
| 5,008,975 | A * | 4/1991 | Wang et al. | 16/266 |
| 5,165,941 | A | 11/1992 | Hawley | |
| 5,711,349 | A | 1/1998 | Wissmann | |
| 5,851,469 | A | 12/1998 | Muller et al. | |
| 6,448,307 | B1 | 9/2002 | Medoff et al. | |
| 6,773,255 | B2 | 8/2004 | Benz et al. | |
| 6,780,359 | B1 | 8/2004 | Zehner et al. | |
| 6,784,216 | B1 | 8/2004 | Zehner et al. | |
| 6,784,230 | B1 | 8/2004 | Patterson et al. | |
| 6,793,474 | B2 | 9/2004 | Gröeblacher et al. | |
| 6,844,049 | B2 | 1/2005 | Amin-Javaheri | |
| 6,863,972 | B2 | 3/2005 | Burger et al. | |
| 6,958,185 | B1 | 10/2005 | Zehner | |
| 6,971,211 | B1 | 12/2005 | Zehner | |
| 6,984,676 | B1 | 1/2006 | Brandt | |
| 7,017,352 | B2 | 3/2006 | Hutchison et al. | |
| 7,030,179 | B2 | 4/2006 | Patterson et al. | |
| 7,186,457 | B1 | 3/2007 | Zehner et al. | |
| 7,445,840 | B2 | 11/2008 | Moriya et al. | |
| 7,743,567 | B1 | 6/2010 | Buhrts | |
| 2001/0019749 | A1 | 9/2001 | Godavarti et al. | |
| 2001/0051242 | A1 | 12/2001 | Godavarti et al. | |
| 2001/0051243 | A1 | 12/2001 | Godavarti et al. | |
| 2002/0015820 | A1 | 2/2002 | Puppin | |
| 2002/0038684 | A1 | 4/2002 | Puppin | |
| 2002/0040557 | A1 | 4/2002 | Felton | |
| 2002/0066248 | A1 | 6/2002 | Buhrts et al. | |
| 2002/0090471 | A1 | 7/2002 | Burger et al. | |
| 2002/0092256 | A1 | 7/2002 | Hendrickson et al. | |

(Continued)

FOREIGN PATENT DOCUMENTS

| | | |
|---|---|---|
| CA | 2153659 A1 | 2/1999 |

(Continued)

*Primary Examiner* — Anita M King
(74) *Attorney, Agent, or Firm* — Standley Law Group LLP

(57) ABSTRACT

An improved bracketing system comprising a first portion that is adjustably connected to a second portion. The first portion may pivot, rotate, or otherwise be adjusted relative to the second portion to accommodate perpendicular and angled installations. An exemplary embodiment of the bracketing system may include angled holes to receive fasteners, which may promote ease of installation. An exemplary embodiment of the bracketing system may also provide additional strength when installed.

17 Claims, 24 Drawing Sheets

U.S. PATENT DOCUMENTS

| | | | |
|---|---|---|---|
| 2002/0106498 | A1 | 8/2002 | Deaner et al. |
| 2002/0143083 | A1 | 10/2002 | Korney, Jr. |
| 2002/0161072 | A1 | 10/2002 | Jacoby et al. |
| 2002/0166327 | A1 | 11/2002 | Brandt et al. |
| 2002/0174663 | A1 | 11/2002 | Hutchison et al. |
| 2002/0192401 | A1 | 12/2002 | Matsumoto et al. |
| 2002/0192431 | A1 | 12/2002 | Edgman |
| 2003/0021915 | A1 | 1/2003 | Rohatgi et al. |
| 2003/0025233 | A1 | 2/2003 | Korney, Jr. |
| 2003/0050378 | A1 | 3/2003 | Blanchard et al. |
| 2003/0087994 | A1 | 5/2003 | Frechette |
| 2003/0087996 | A1 | 5/2003 | Hutchison et al. |
| 2003/0154662 | A1 | 8/2003 | Bruchu et al. |
| 2003/0229160 | A1 | 12/2003 | Williams et al. |
| 2004/0026021 | A1 | 2/2004 | Groh et al. |
| 2004/0048055 | A1 | 3/2004 | Branca |
| 2004/0071964 | A1 | 4/2004 | Nesbitt |
| 2004/0148965 | A1 | 8/2004 | Hutchison et al. |
| 2004/0191494 | A1 | 9/2004 | Nesbitt |
| 2004/0219357 | A1 | 11/2004 | Van Dijk et al. |
| 2005/0009960 | A1 | 1/2005 | Ton-That et al. |
| 2005/0013984 | A1 | 1/2005 | Dijk et al. |
| 2005/0266222 | A1 | 12/2005 | Clark et al. |
| 2005/0271872 | A1 | 12/2005 | Dolinar |
| 2005/0271889 | A1 | 12/2005 | Dolinar |
| 2006/0010883 | A1 | 1/2006 | Hutchison et al. |
| 2006/0010884 | A1 | 1/2006 | Hutchison et al. |
| 2006/0012066 | A1 | 1/2006 | Hutchison et al. |
| 2006/0012071 | A1 | 1/2006 | Groh et al. |
| 2006/0022372 | A1 | 2/2006 | Matuana et al. |
| 2006/0068053 | A1 | 3/2006 | Brandt et al. |
| 2006/0068215 | A2 | 3/2006 | Dolinar |
| 2008/0093763 | A1 | 4/2008 | Mancosh et al. |
| 2009/0264560 | A1 | 10/2009 | Warnes et al. |

FOREIGN PATENT DOCUMENTS

| | | | |
|---|---|---|---|
| CH | 580130 | A5 | 9/1976 |
| CL | 343-95 | | 3/1995 |
| CL | 3037-99 | | 12/1999 |
| DE | 2042176 | | 4/1971 |
| DE | 3801574 | A1 | 8/1989 |
| DE | 4033849 | A1 | 4/1991 |
| DE | 4221070 | A1 | 12/1993 |
| DK | 140148 | B | 6/1979 |
| EP | 0269470 | A2 | 1/1988 |
| EP | 0586211 | A1 | 3/1994 |
| EP | 0586212 | A2 | 3/1994 |
| EP | 0586213 | A1 | 3/1994 |
| EP | 0668142 | A1 | 8/1995 |
| EP | 0747419 | A2 | 12/1996 |
| FR | 2270311 | A1 | 12/1975 |
| FR | 2365017 | A1 | 4/1978 |
| FR | 2445885 | A1 | 8/1980 |
| FR | 2564374 | A1 | 11/1985 |
| GB | 1298823 | | 12/1972 |
| GB | 1443194 | | 7/1976 |
| GB | 2036148 | A | 6/1980 |
| GB | 2104903 | A | 3/1983 |
| GB | 2171953 | A | 9/1986 |
| GB | 2186655 | A | 8/1987 |
| JP | 57-190035 | A | 11/1982 |
| JP | 2000-17245 | A | 1/2000 |
| JP | 2000-109589 | A | 4/2000 |
| JP | 2002-86544 | A | 3/2002 |
| JP | 2002-113768 | A | 4/2002 |
| JP | 2002-137333 | A | 5/2002 |
| JP | 2002-144489 | A | 5/2002 |
| WO | 90/08020 | A1 | 7/1990 |
| WO | 95/13179 | A1 | 5/1995 |
| WO | 99/11444 | A1 | 3/1999 |
| WO | 00/11282 | A2 | 3/2000 |
| WO | 00/34017 | A1 | 6/2000 |
| WO | 00/39207 | A1 | 7/2000 |
| WO | 01/66873 | A1 | 9/2001 |
| WO | 02/057692 | A2 | 7/2002 |
| WO | 02/079317 | A1 | 10/2002 |
| WO | 02/103113 | A2 | 12/2002 |
| WO | 03/091642 | A1 | 11/2003 |
| WO | 2004/083541 | A2 | 9/2004 |
| WO | 2004/083541 | A3 | 11/2004 |
| WO | 2004/102092 | A1 | 11/2004 |
| WO | 2006/041508 | A2 | 4/2006 |
| WO | 2006/071517 | A2 | 7/2006 |
| WO | 2007/085836 | A1 | 8/2007 |

* cited by examiner

BRACKETING SYSTEM

BACKGROUND AND SUMMARY OF THE INVENTION

Railing systems have been used in various forms to protect and secure people, animals, and land. Railing systems have also been used to prevent entry into a designated area. While these functional railing uses continue today, railing systems may also be used for decorative purposes such as on porches and decks and around yards and gardens.

Known railing systems suffer from various drawbacks. For instance, many conventional railing systems are difficult to install, thereby requiring significant amounts of on-site labor. In addition, many railing systems require an excessive number of parts in order to complete an installation. For example, known systems may require different components for perpendicular and angled installations (e.g., relative to a support post). In other words, these systems may require different components for perpendicular installations as compared to the components used for angled installations. In fact, these systems may also require different components for angled installations in which the railing is horizontal as compared to angled installations in which the railing is at a vertical angle relative to a support post (e.g., a stair rail installation). As might be expected, the extra components may increase the complexity and cost of the manufacturing, shipping, and installation of the railing assembly. On the other hand, some existing railing assemblies may not even allow angled installations. Moreover, known railing systems may also fail to provide a desired aesthetic appearance. For example, these railing systems may leave the support hardware exposed, which limits the visual appearance of the product. In light of shortcomings such as these, there is a need for an improved rail system and method of assembly.

An exemplary embodiment of the present invention provides a rail system that may be comprised of any material that is suitable for the intended purpose of the railing. For example, the rail system may be comprised of a composite material that is durable and resistant to weathering. In addition, an exemplary embodiment of the rail system may be easily assembled on-site. If desired, the rail system may be at least partially pre-assembled at an off-site location. In one exemplary embodiment, the rail system may be uniquely designed to accommodate perpendicular and angled installations (e.g., both in the horizontal and vertical planes). In another exemplary embodiment, the rail system may be easily assembled such that the support hardware is substantially hidden from view after installation, thereby enhancing the appearance of the railing. In light of such benefits, the present invention may provide an easy to install, weather-resistant, safe, secure, and aesthetically pleasing rail system that is suitable for a variety of indoor and outdoor uses.

Another exemplary embodiment of the present invention provides an improved bracketing system. An example of an improved bracketing system may comprise a first portion that is adjustably connected to a second portion. The first portion may pivot, rotate, or otherwise be adjusted relative to the second portion to accommodate perpendicular and angled installations. An exemplary embodiment of a bracketing system may include angled holes to receive fasteners, which may promote ease of installation. An exemplary embodiment of a bracketing system may also provide additional strength when installed.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENTS

Figure 1:
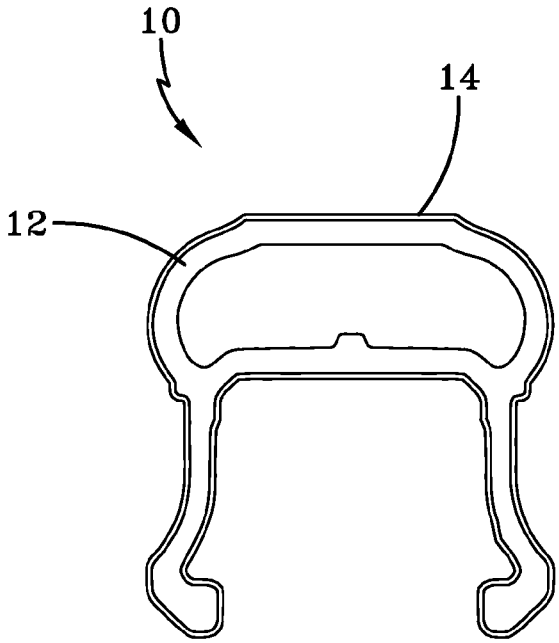
FIG. 1 is a cross-sectional view of an exemplary embodiment of a rail of the present invention.

FIG. 1 illustrates an example of a component of the present invention. In this example, handrail or top rail 10 (hereinafter generally and collectively referred to as a handrail for ease of description) may be comprised of a composite substrate 12 and a capstock layer 14. The handrail 10 may, for example, be useful for a deck railing system or other similar or suitable types of railing.

Figure 2:
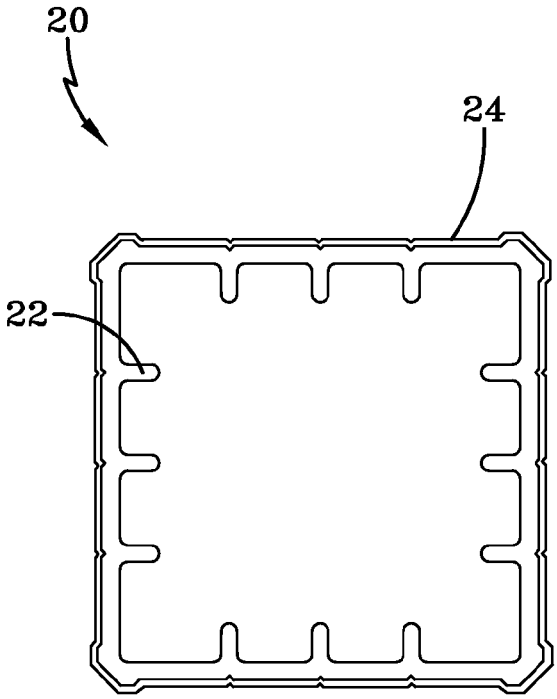
FIG. 2 is a cross-sectional view of an exemplary embodiment of a post cover of the present invention.

Another exemplary component of the present invention is illustrated in FIG. 2. FIG. 2 shows an exemplary rail post cover 20 that also comprises a composite substrate 22 and a capstock layer 24. Such a cover may be installed, for example, over an existing wood post to provide an aesthetically pleasing appearance as well as to provide protection from exposure to the elements.

FIGS. 3A through 22D show an example of a railing system that may utilize the components shown in FIGS. 1 and 2. The novel features of this exemplary embodiment provide an easy method of assembling the rail components to accommodate linear and angled walkways (e.g., decks) as well as stair rail applications that require changes in elevation.

In particular, rail 10 and rail 50 may be directly or indirectly connected to post cover 20 at a variety of horizontal and vertical angles, such as for deck and stair applications. Optional post covers 20, post caps 26, and post skirts 28 may be installed over pre-installed posts from which they derive structural rigidity and strength. Nevertheless, it should be recognized that the railing may utilize a post without the benefit of the post cover components.

Figure 3A:
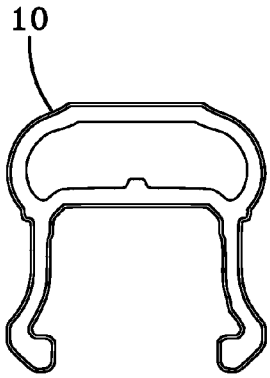
FIGS. 3A through 3K illustrates the components of an exemplary embodiment of a rail system that may utilize the present invention.
Figure 3B:
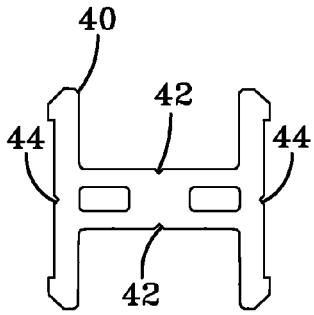
Figure 3C:
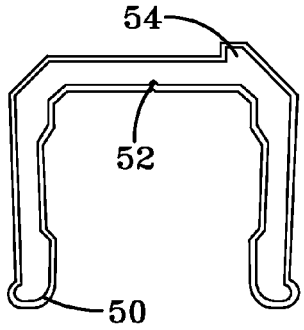
Figure 3D:
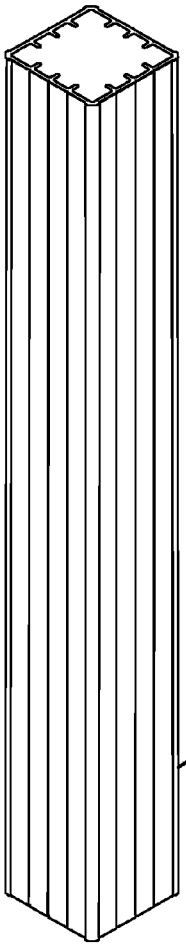
Figure 3E:
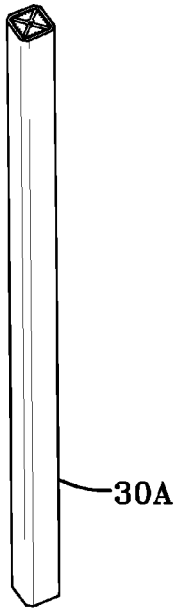
Figure 3G:
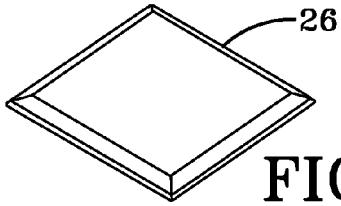
Figure 3H:
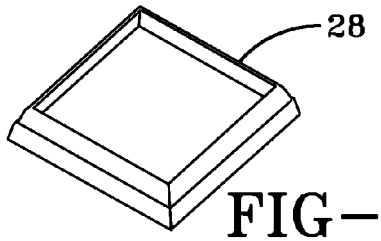
Figure 3I:
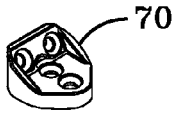

In the railing system, balusters 30A or 30B extend between an upper support rail 40 and bottom rail 50. FIG. 3E shows an example of a baluster 30A, which has inner webbing and a screw boss. However, as shown in subsequent figures, exemplary embodiments of the present invention also include baluster configurations that do not have inner webbing.

Top rail 10 and bottom rail 50 are fitted over respective support rails 40. At least one squash block 60 may be installed beneath the lower support rail 40 where desired to provide additional rigidity and support against sagging (e.g., for long spans of railing that extend between post covers 20). A squash block 60 may have a design similar to a baluster, and it may have similar means of connection (e.g., via a screw boss or plug) to a support rail 40 as a baluster.

Figure 3K:
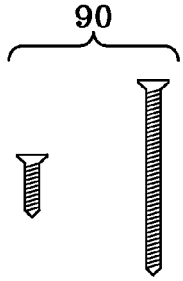
Figure 3F:
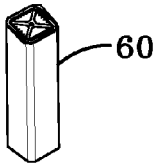
Figure 3J:
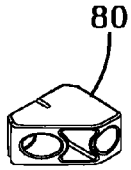

Brackets 70 and support blocks 80 provide a means for directly or indirectly attaching the support rails 40 to the post covers 20. Optionally, fasteners 90 may be used to secure brackets 70 and support blocks 80 to post covers 20 and support rails 40. It should be noted that FIG. 3K shows various sizes of fasteners, which are collectively identified as fasteners 90. An appropriate size of fastener 90 may be selected for each intended use. Examples of fasteners 90 include, but are not limited to, screws, nails, and other similar or suitable mechanical fastening devices. In some embodiments of the railing, other means (e.g., adhesives or a suitable interference fit) may be used alone or in combination with fasteners 90 to secure brackets 70 and support blocks 80.

Figure 4:
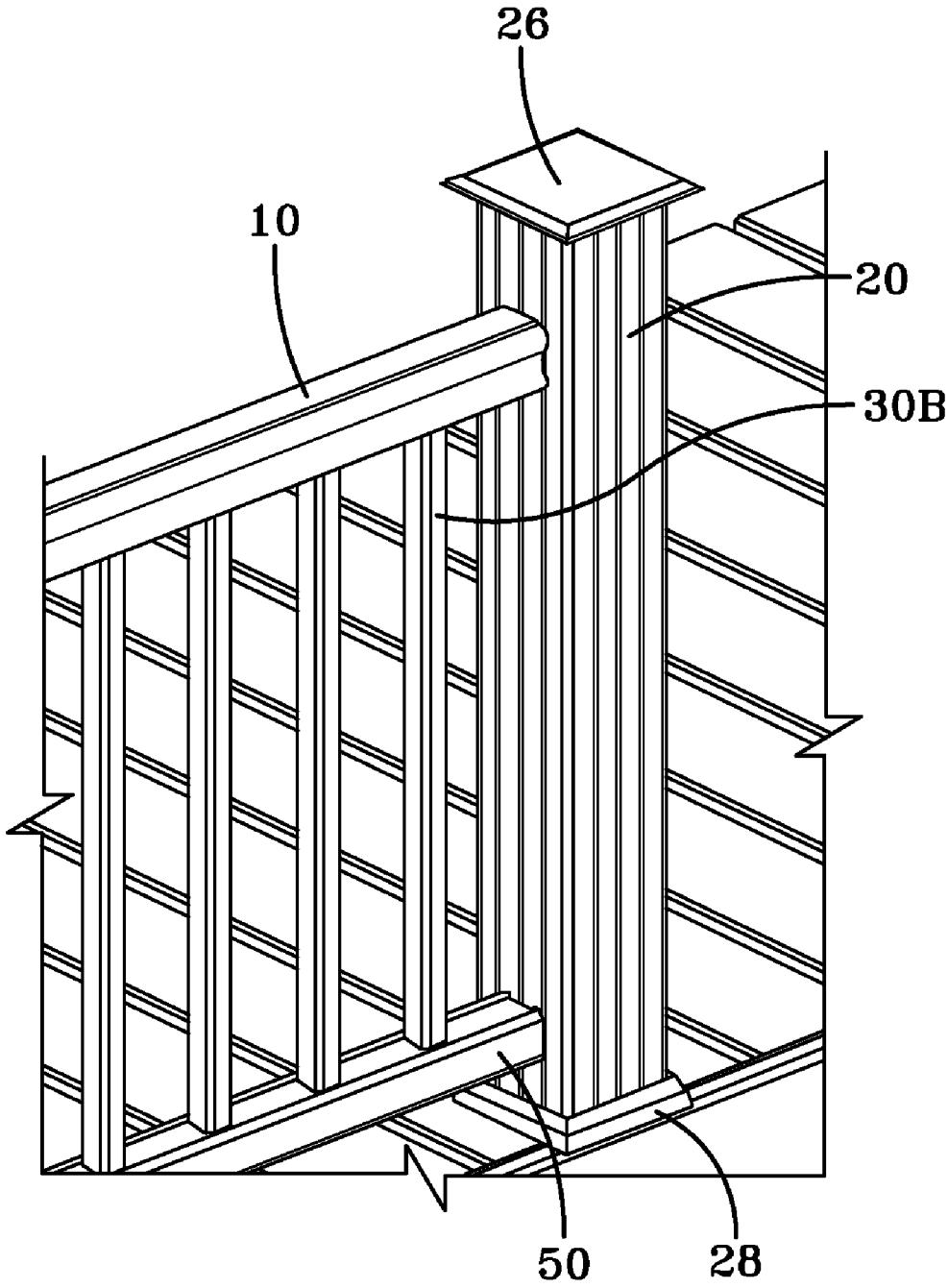
FIG. 4 is a partial perspective view of an exemplary embodiment of a rail system using at least some of the components of FIGS. 3A through 3K.

FIG. 4 illustrates an exemplary handrail installation showing the relative positions of top rail 10, post cover 20, post cap 26, post skirt 28, bottom rail 50, and interconnecting balusters 30B. It should be noted that in this exemplary embodiment, any or all of the components may be fabricated as described above to provide a durable, weather-resistant, and aesthetically pleasing railing system.

Figure 5:
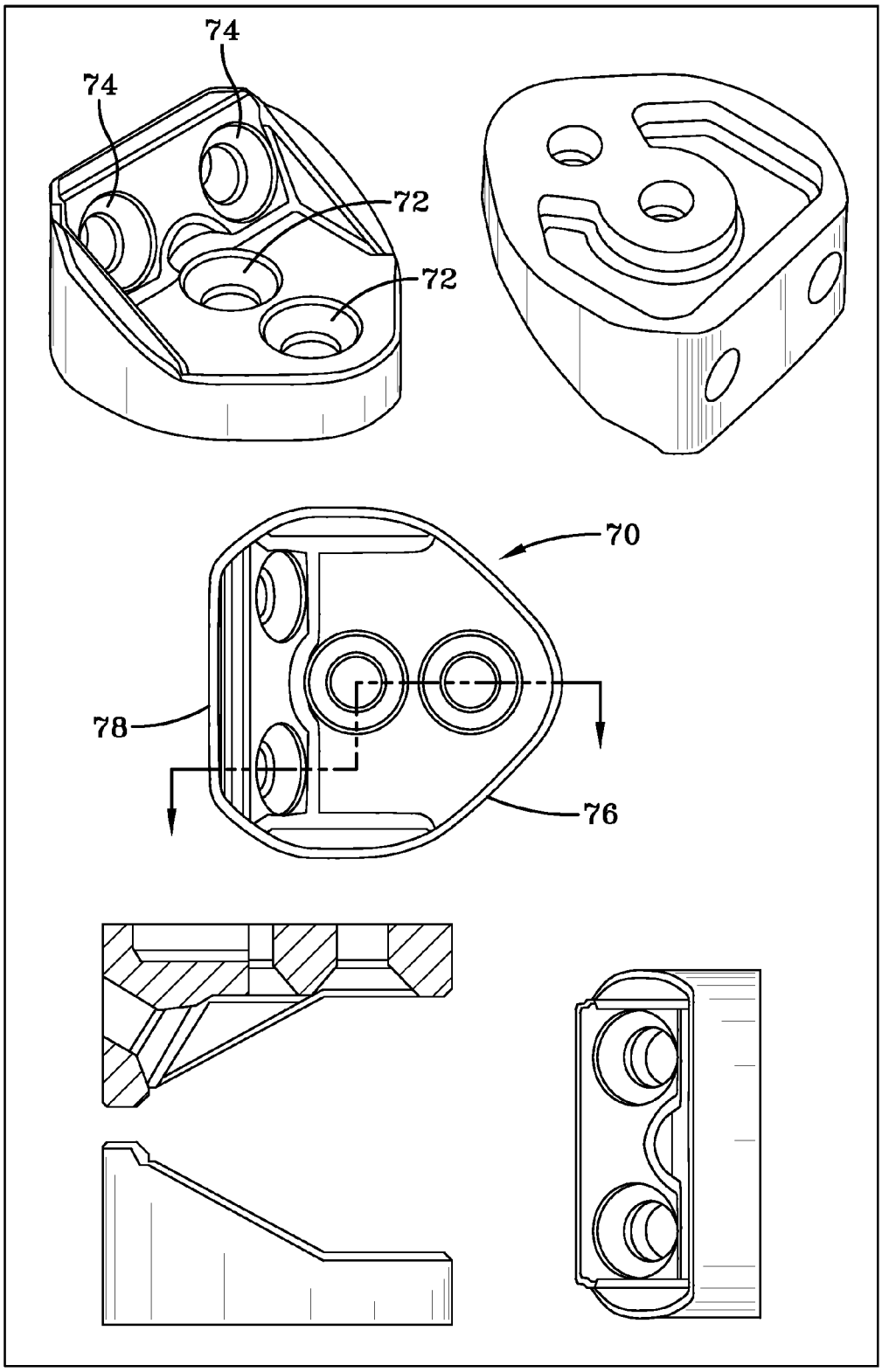
FIG. 5 illustrates various views of the exemplary embodiment of the bracket of FIG. 3I.
Figure 6:
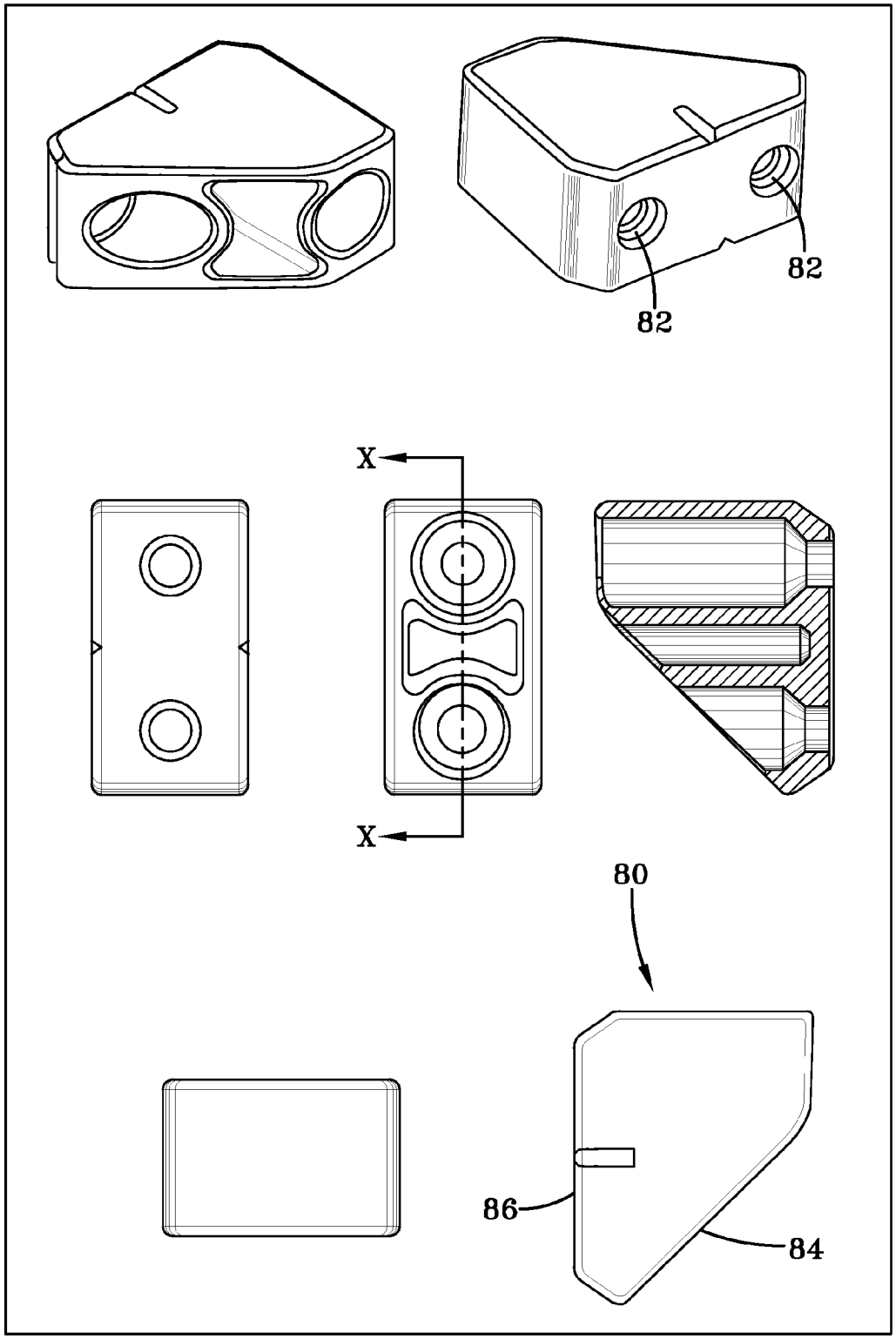
FIG. 6 illustrates various views of the exemplary embodiment of the support block of FIG. 3J.

FIGS. 5 and 6 illustrate a bracket 70 and support block 80, respectively, that may be used to connect the principal components of a handrail system together. Holes 72, 74, and 82 are adapted to accept fasteners 90 to facilitate the assembly of the rail system. Angled surface portions 76 and 84 on bracket 70 and support block 80, respectively, allow component connections over a range of angles to accommodate different installation configurations, such as angled walkways, decks, or stairways. As a result, in an exemplary embodiment of the present invention, bracket 70 and support block 80 may be used for perpendicular as well as angled connections of a rail to a post or post cover 20. Thus, the versatility of bracket 70 and support block 80 eliminates the need for different components for perpendicular and angled connections, which may lead to additional benefits including, but not limited to, reduced manufacturing cost and installation time.

In the example of FIG. 5, angled surface portion 76 is at about a 45-degree angle relative to surface portion 78, through which holes 74 extend in a notably oblique manner relative to surface portion 78. Similarly, in the example of FIG. 6, angled surface portion 84 is at about a 45-degee angle relative to surface portion 86, through which holes 82 extend. Such as in this example, at least one hole 82 may extend through surface portion 84 to surface portion 86. As will be shown in subsequent figures, the angled configurations of the bracket 70 and support block 80 may facilitate connections of a rail to a post or post cover 20 over a range of angles. Although these exemplary embodiments of bracket 70 and support block 80 may be used for a 45-degree connection of a rail to a post or post cover 20, it should also be recognized that these exemplary components may be used to for other angled connections (e.g., less than or greater than 45 degrees) of a rail to a post or post cover 20. In addition, it should be recognized that other exemplary embodiments of the bracket and support block may have angled configurations that are less than or greater than 45 degrees and may also allow connections over a range of angles. In fact, in some exemplary embodiments of the present invention, the bracket and support block may not have angled configurations and may still allow for connections over a range of angles.

Figure 7:
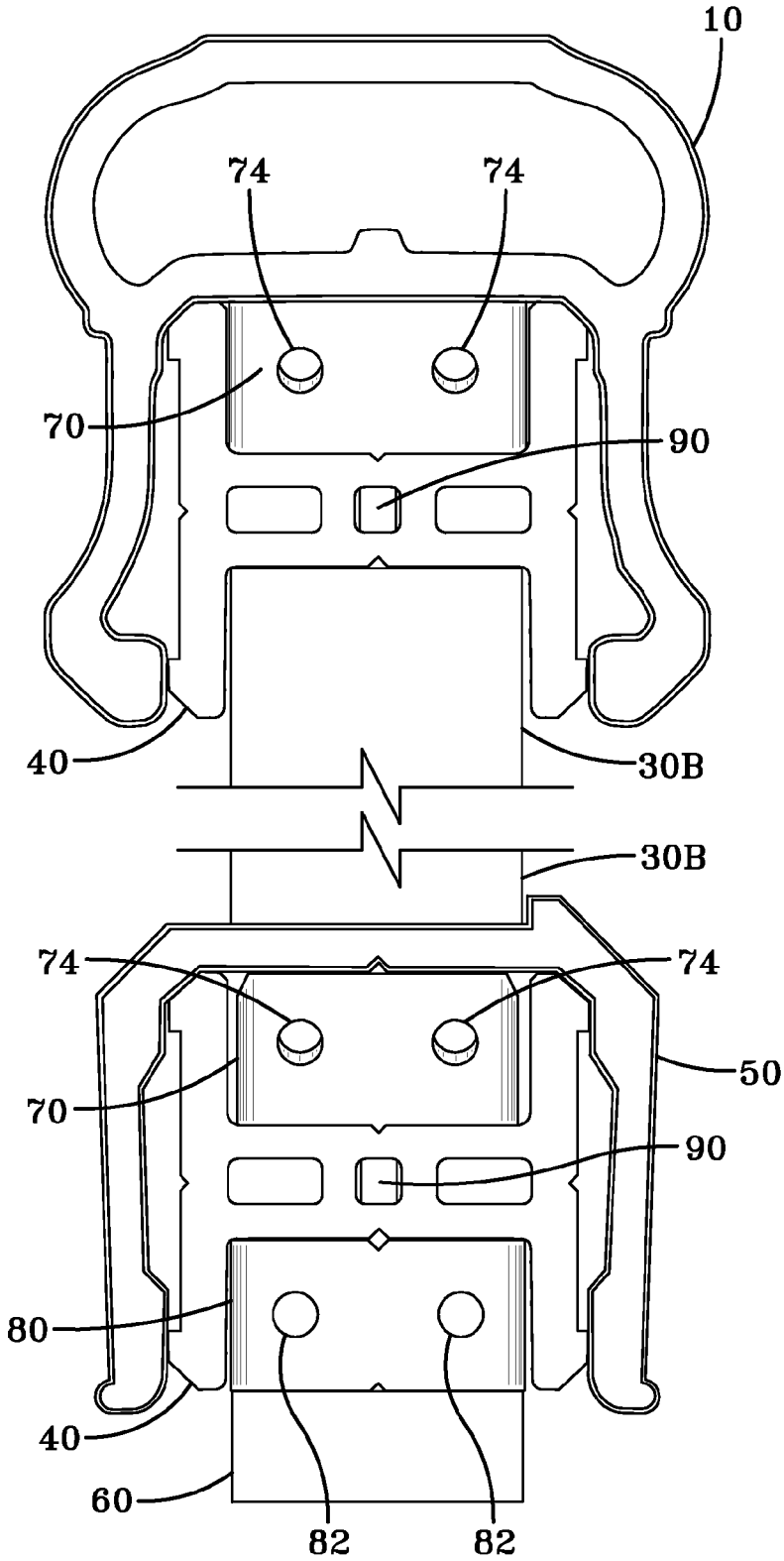
FIG. 7 is a partial, cross-sectional view of an exemplary installation of a rail system using at least some of the components of FIGS. 3A through 3K.

FIG. 7 illustrates one exemplary embodiment of component assembly for perpendicular connections of rails to a post or post cover. In this example, support block 80 is used to support lower support rail 40. Holes 82 are provided so that the support block 80 may be secured to a post, a post cover, or any other desired support structure by fasteners. Optionally, a support block may also include other holes for receiving fasteners to secure the support block to a support rail. Brackets 70 may be similarly used to secure support rails 40 to a post, post cover, or any other desired support structure. In particular, fasteners may be inserted through holes 74 to secure brackets 70 to a support structure. In addition, although not visible in this view, fasteners may also be inserted through holes 72 to secure each bracket 70 to a support rail 40.

Support rails 40 provide a structural foundation upon which to attach top rail 10 and bottom rail 50. A support rail 40 may include at least one hollow. FIG. 3B shows an example of a support rail 40 that includes two hollows, whereas the support rail 40 of the exemplary embodiment shown in FIG. 7 also includes a third (e.g., intermediate or center) hollow. It should be recognized that a support rail 40 may include no hollows or any other desired number of hollows in other exemplary embodiments of the invention. The example of a support rail 40 in FIG. 3B may improve fastener retention.

Each rail has a cavity that is adapted to receive a support rail 40. For example, such as shown in FIG. 7, each rail may have a cavity that is adapted to mate with a support rail 40. Upper rail 10 and lower rail 50 may simply be placed over respective support rails 40, which promotes a relatively easy installation. Fasteners 90 may be used to directly or indirectly secure top rail 10 and, optionally, bottom rail 50 to the respective support rails 40. As can be seen in FIG. 7, this configuration enables support rails 40, brackets 70, support block 80, and fasteners 90 to be substantially or totally obscured from view during normal use of the railing assembly. Moreover, in addition to the pleasing aesthetic appearance of the resulting railing assembly, this exemplary embodiment of the present invention provides a weather-resistant covering for the support components.

In the example of FIG. 7, each support rail 40 is oriented such that it has a generally H-shaped configuration. This orientation enables the brackets 70 and support block 80 to provide both perpendicular and angled connections of a rail over a range of angles, wherein the rail may be generally horizontal, if desired. As mentioned above, fasteners 90 may be used to secure top rail 10 and bottom rail 50 to respective support rails 40. Fasteners 90 may also be used to directly or indirectly connect balusters 30B and squash block 60 to respective support rails 40. Additionally, alignment grooves 42, as illustrated in FIG. 3B, may be provided on support rail 40 to provide an easy and quick method of locating fasteners 90 along the centerline, if desired, of the support rail 40. For the same reason, bottom rail 50 may optionally include an alignment groove 52. Similarly, top rail 10 may include an alignment groove, if desired. Optionally, holes may also be provided in predetermined locations (e.g., in the alignment grooves 42 and 52) for the reception of fasteners 90. Such fastener holes may be pre-drilled or otherwise pre-formed before assembly, or such fastener holes may be drilled or otherwise formed during assembly.

Figure 8A:
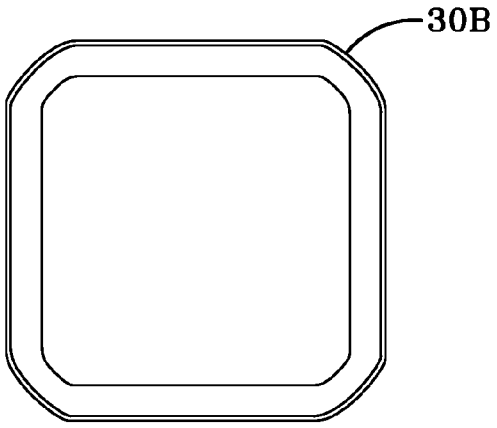
FIG. 8A is a cross-sectional view of an exemplary embodiment of a baluster of a rail system.
Figure 8B:
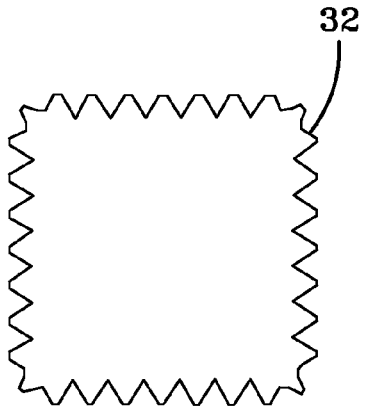
FIG. 8B is a cross-sectional view of an exemplary embodiment of a baluster plug.
Figure 8C:
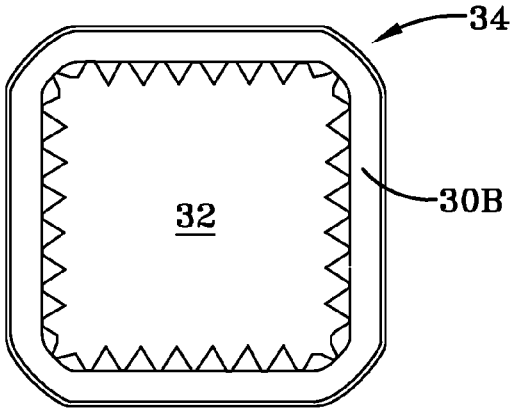
FIG. 8C is a cross-sectional view of the baluster of FIG. 8A with baluster plug of FIG. 8B installed.
Figure 8D:
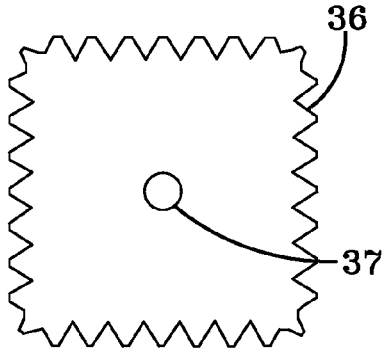
FIG. 8D is a cross-sectional view of an exemplary embodiment of a baluster plug with a hole.
Figure 8E:
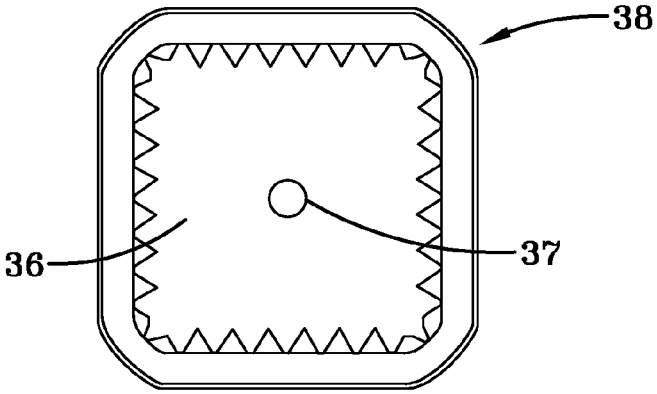
FIG. 8E is a cross-sectional view of an exemplary embodiment of a baluster with the baluster plug of FIG. 8D installed.
Figure 8F:
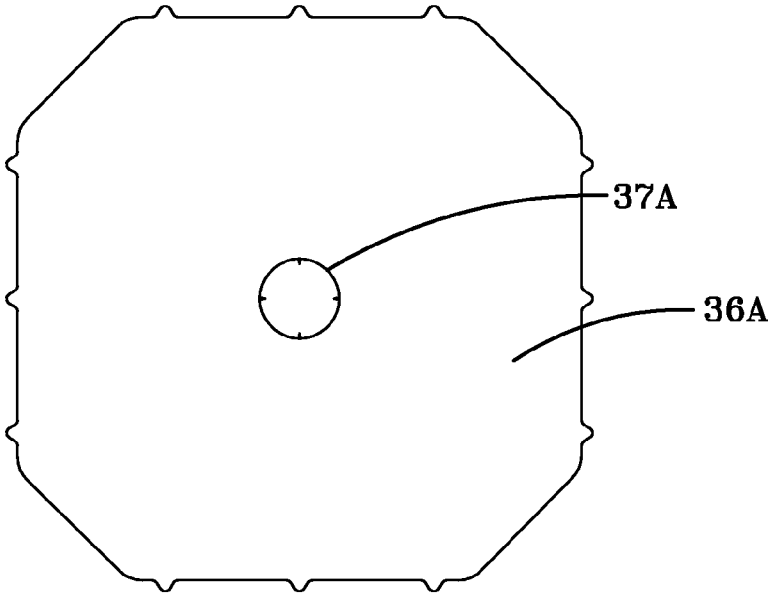
FIG. 8F is cross-sectional view of another exemplary embodiment of a baluster plug with a hole.
Figure 8G:
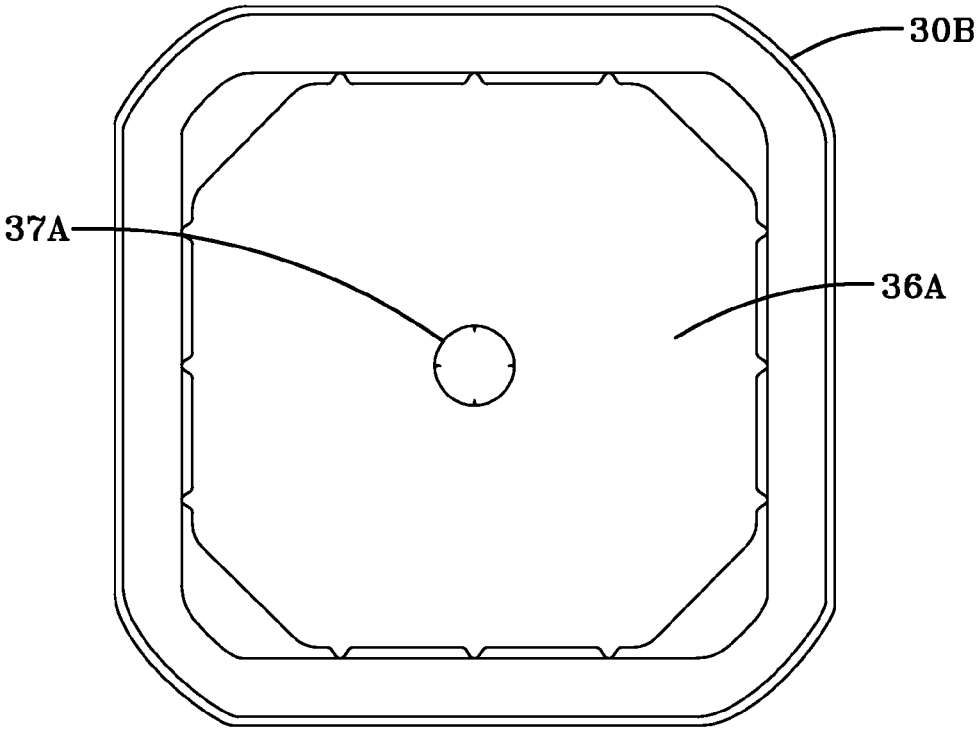
FIG. 8G is a cross-sectional view of an exemplary embodiment of a baluster with the baluster plug of FIG. 8F installed.

FIG. 8A illustrates a cross-sectional view of another exemplary embodiment of a baluster 30B, which may be a hollow tubular-like structure. FIG. 8B illustrates an example of an exemplary embodiment of a baluster plug 32, which optionally may comprise a grooved periphery to allow the application and retention of an adhesive or bonding agent. FIG. 8C illustrates a cross-sectional view of a baluster assembly 34 with may comprise a baluster 30B with a baluster plug 32 installed on at least one end portion of the baluster 30B. Alternatively, a single baluster plug 32 may extend the full length of the baluster 30B. In either case, the baluster plug or plugs 32 may be drilled before or after assembly within the baluster 30B to accommodate appropriate assembly fasteners 90. FIG. 8D depicts a baluster plug 36 comprising a pre-drilled or otherwise pre-formed fastener hole 37. For example, baluster plug 36 may be molded (e.g., extruded) such that it has fastener hole 37. FIG. 8E illustrates an example of a baluster assembly 38 that includes baluster plug(s) 36. FIG. 8F shows another example of a baluster plug 36A comprising a plurality of protrusions on its periphery and a fastener hole 37A, and FIG. 8G shows an example of a baluster assembly that includes baluster plug(s) 36A. It should be noted that the baluster 30B and baluster plugs 32, 36, and 36A may be comprised of a plastic, plastic composite material, or any other similar or suitable material such as described herein and may be fabricated by molding, extrusion, or any other suitable process or method known to those skilled in the art. Furthermore, it should be recognized that exemplary embodiments of a squash block may also be comprised of components similar to the above-described baluster assemblies 34 and 38 as well as the exemplary baluster assembly of FIG. 8G.

Figure 9:
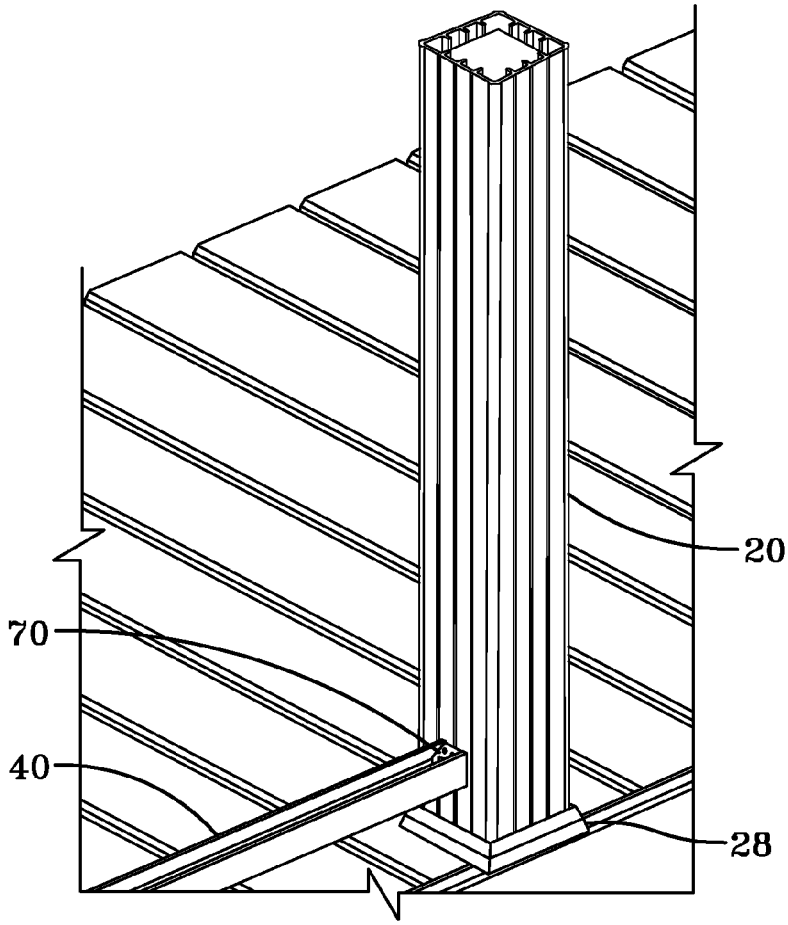
FIG. 9 is a partial perspective view of an exemplary embodiment of an installed lower support rail.
Figure 10:
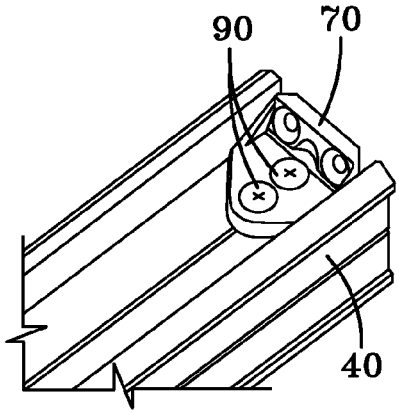
FIG. 10 is a partial perspective view illustrating an exemplary manner of attaching a bracket to a support rail.
Figure 11:
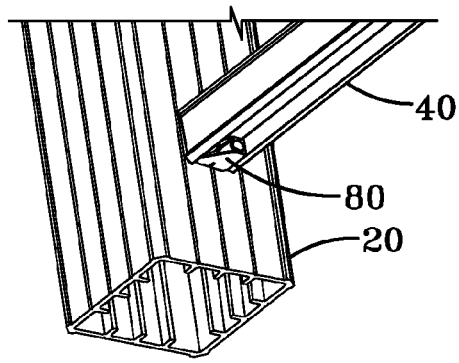
FIG. 11 is another partial perspective view of an exemplary embodiment of an installed lower support rail.

FIGS. 9 through 11 illustrate various views of an exemplary assembly configuration showing the installation of a lower support rail 40. In this example, support rail 40 is substantially perpendicular to post cover 20. As shown in the partial view of FIG. 11, support rail 40 rests on support block 80. Although FIG. 11 shows a straight rail configuration, it is evident that support block 80 may enable angled connections up to about 45 to 50 degrees in this example. In addition, as shown in FIGS. 9 and 10, a bracket 70 is used to secure support rail 40 to the post cover 20. In this exemplary configuration, fasteners 90 are aligned with the centerline of support rail 40.

Figure 12:
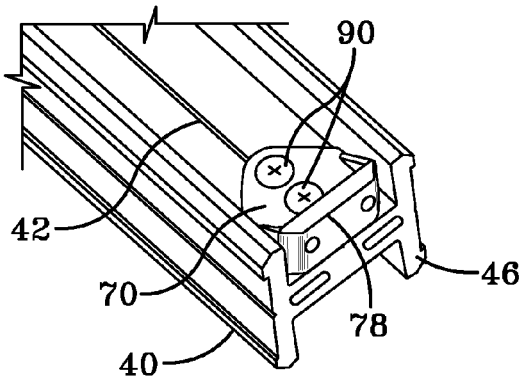
FIG. 12 is another partial perspective view illustrating an exemplary manner of attaching a bracket to a support rail.
Figure 13:
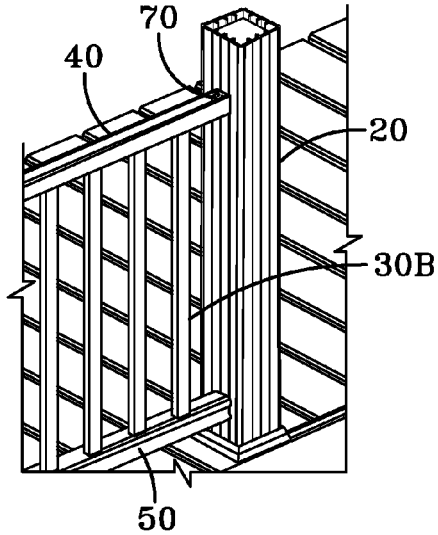
FIG. 13 is a partial perspective view of an exemplary manner of attaching a bottom rail and balusters to an upper support rail.

FIGS. 12 and 13 show in more detail the component relationship between a bracket and support rail in a straight rail configuration. As shown in FIG. 12, surface portion 78 of bracket 70 may be substantially aligned with edge 46 of support rail 40. Fasteners 90 may be inserted through holes 72 in bracket 70 to secure bracket 70 to support rail 40. Fasteners 90 may also be inserted through holes 74 in surface portion 78 in order to secure bracket 70 and support rail 40 to post cover 20. FIG. 13 shows lower rail 50 installed over lower support rail 40. FIG. 13 also shows the installation of balusters 30B and upper support rail 40. In an exemplary embodiment, balusters 30B may be pre-assembled between upper support rail 40 and lower rail 50 using fasteners 90 so that these components may be installed as a single unit to facilitate installation in the field. Prior to being fastened, balusters 30B may be spaced along the rail as desired.

In the example of FIG. 12, it should be note that the support rail 40 embodies an alignment groove 42, which provides a ready reference that may be used to easily locate fasteners 90 for securing bracket 70 to support rail 40. As previously noted, support rail 40 may be drilled or otherwise provided with holes to accommodate assembly fasteners 90. The alignment groove 42 may be embodied onto the surface of the support rail 40 by means of a groove during the manufacturing process, such as extrusion, or it may be subsequently applied by means of a marking method, such as through the use of marking inks, etching, or other methods known to those knowledgeable in the art.

Figure 14:
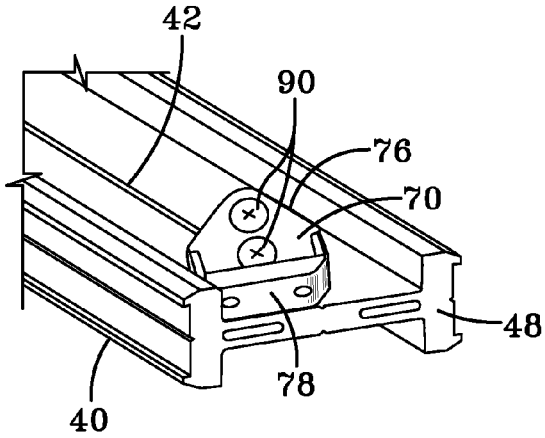
FIG. 14 is a partial perspective view of an exemplary manner of attaching a bracket to a support rail for an angled installation of a rail.
Figure 15:
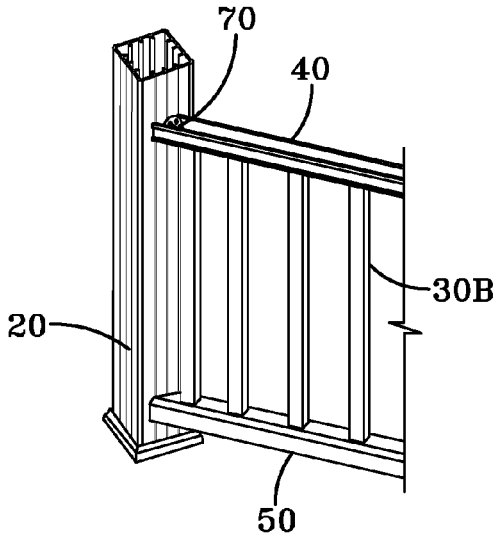
FIG. 15 is a partial perspective view of an exemplary manner of attaching a bottom rail and balusters to an upper support rail for an angled installation of a rail.

FIGS. 14 and 15 illustrate an example of how bracket 70 may be attached to support rail 40 for an angled rail installation. In this example, support rail 40 may be cut or formed in any other suitable manner such that it has an angled edge 48. The angle of edge 48 may be selected to provide the desired angular connection between the rail and post cover 20. Surface or face portion 78 of bracket 70 may be substantially aligned with angled edge 48 of support rail 40. Fasteners 90 may be inserted through holes 72 in bracket 70 in order to secure bracket 70 to support rail 40. As shown in this example, at least one of the holes 72 may aligned with optional alignment groove 42 in order to properly position bracket 70 on support rail 40. In other words, the center fastener is aligned with the alignment groove 42 in this example. As depicted in FIG. 15, angled edge 48 may be situated against (e.g., adjacent) post cover 20. Fasteners 90 may be inserted through holes 74 in surface portion 78 in order to directly or indirectly secure bracket 70 and support rail 40 to post cover 20 (e.g., via an underlying post), thereby providing the desired angular connection. Lower rail 50 may have an edge that has an angle similar to that of edge 48, and it may be situated over lower support rail 40 as shown in FIG. 15. FIG. 15 also shows balusters 30B and upper support rail 40.

Figure 16:
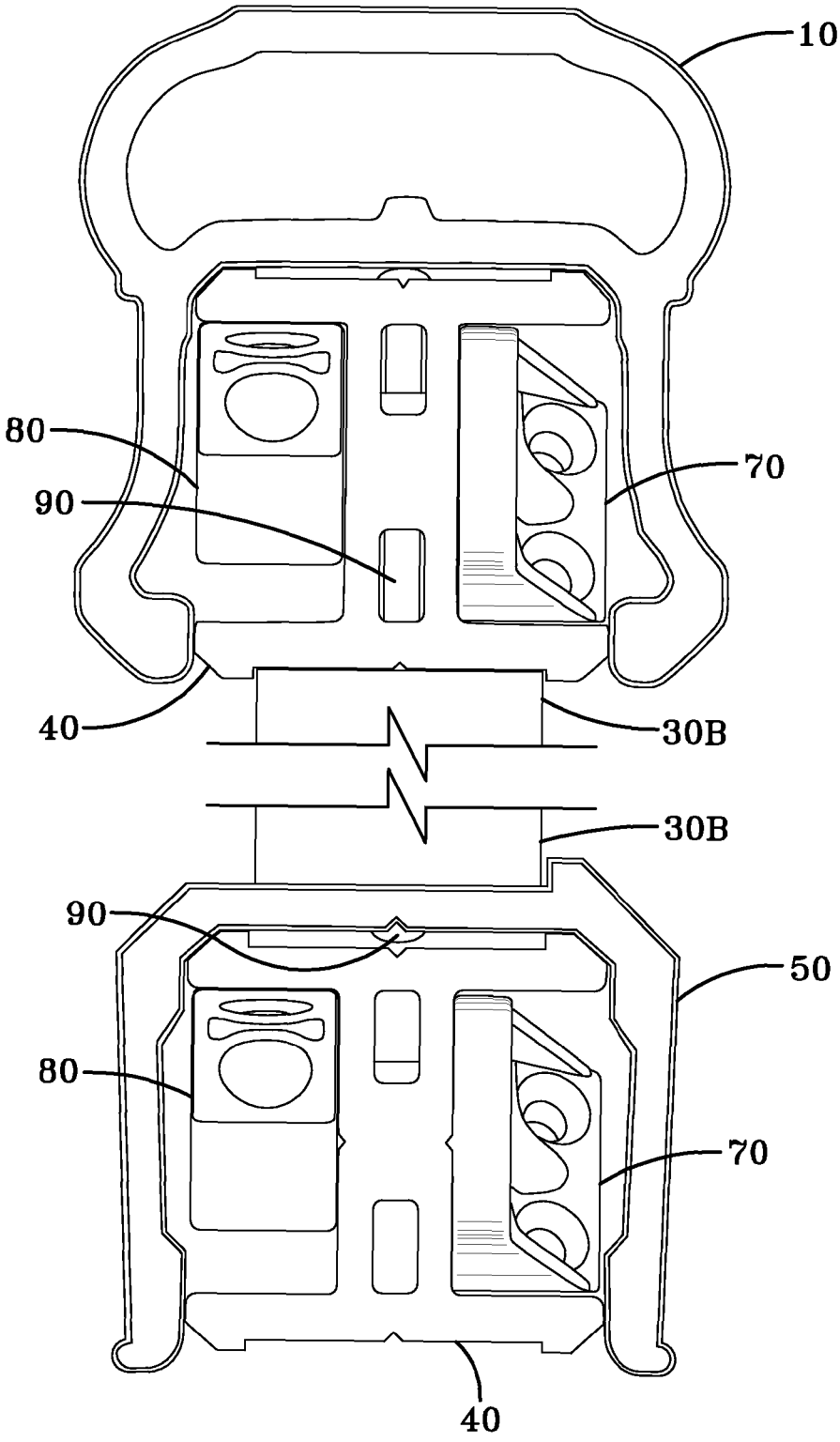
FIG. 16 is a partial, cross-sectional view of an exemplary installation of a rail system in a stair rail application.

FIG. 16 shows a different arrangement of the above-described components for applications requiring rails on changing elevations, for example, as in a stair rail. This configuration allows a rail to be connected to a support structure over a range of angles. As a result, this configuration may be used when a rail is supported at different levels, such as in a stair system or in any other system in which a rail is not level. Relative to the example shown in FIG. 7, support rails 40, brackets 70, and support blocks 80 are rotated about 90 degrees as shown in the example of FIG. 16. As a result, in this configuration, each support rail 40 is positioned such that it is substantially I-shaped. At least one of the support rails 40 is supported by a support block 80. Brackets 70 may be used in conjunction with fasteners 90 to effectively (e.g., directly or indirectly) secure respective support rails 40 to a support structure, such as a post cover 20 or any other available support surface (e.g., a building wall). Fasteners 90 may also be used to secure support rail 40 to baluster 30B. Optionally, each support rail may have at least one alignment groove 44 to assist in aligning the support rail with baluster 30B. If desired, holes may also be provided in predetermined locations (e.g., in the alignment grooves 44 and 52) for the reception of fasteners 90. Such fastener holes may be pre-drilled or otherwise pre-formed before assembly, or such fastener holes may be drilled or otherwise formed during assembly.

Figure 17:
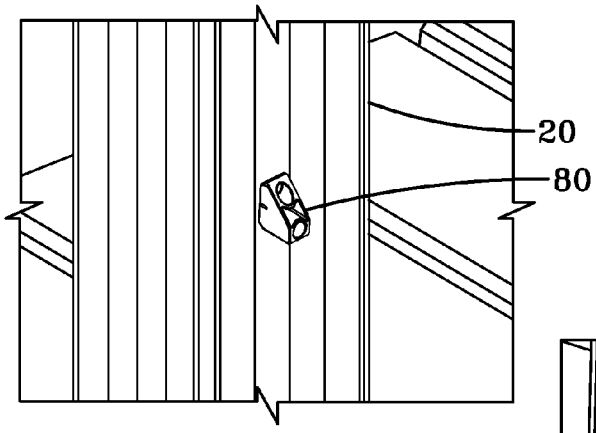
FIG. 17 is a partial perspective view illustrating an exemplary manner of attaching a support block to a post cover in a stair rail installation.
Figure 18:
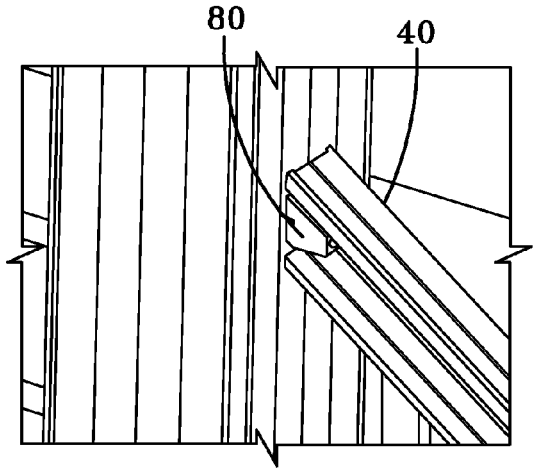
FIG. 18 is a partial perspective view illustrating an exemplary manner of attaching a support rail and support block to a post in a stair rail installation.
Figure 19:
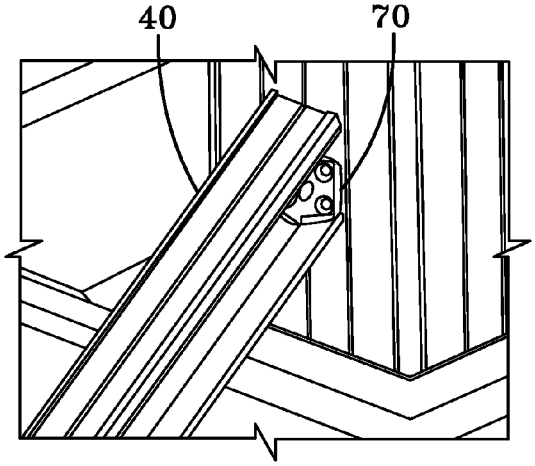
FIG. 19 is a partial perspective view illustrating an exemplary manner of attaching a support rail and bracket to a post in a stair rail installation.
Figure 20:
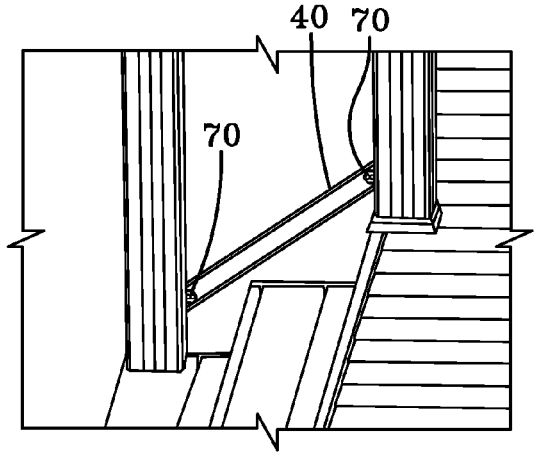
FIG. 20 is a partial perspective view illustrating an exemplary installation of a support rail between two posts in a stair rail application.

FIGS. 17 through 20 illustrate the component assembly relationships in an exemplary stair rail application requiring changes in rail elevation. As shown in FIG. 17, fasteners 90 may be inserted through holes 82 to secure support block 80 to post cover 20. FIG. 18 shows the subsequent positioning of a support rail 40 relative to support block 80. FIG. 19 depicts an exemplary attachment of a bracket 70 to a support rail 40. In an exemplary embodiment, bracket 70 may be pre-mounted to support rail 40 using fasteners 90. Fasteners 90 may also be inserted through holes 74 of bracket 70 to secure support rail 40 and bracket 70 to post cover 20 (e.g., via an underlying post). FIG. 20 illustrates an exemplary installation of a lower support rail 40 in a stair rail application.

Figure 21A:
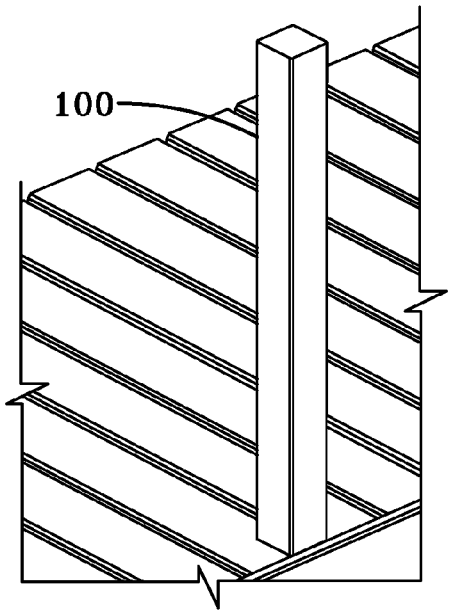
FIGS. 21A through 21H are partial perspective views illustrating a sequential step-by-step installation of an exemplary embodiment of a handrail system.
Figure 21B:
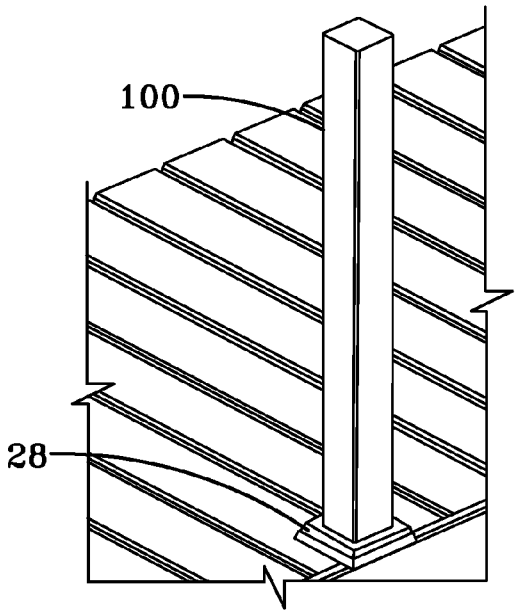
Figure 21C:
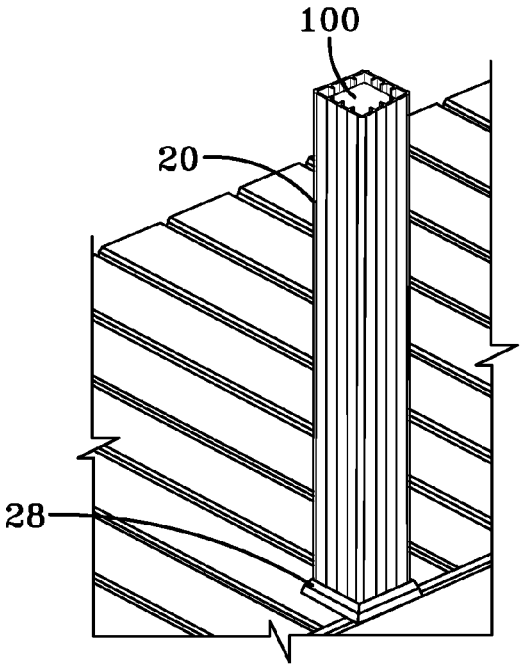
Figure 21D:
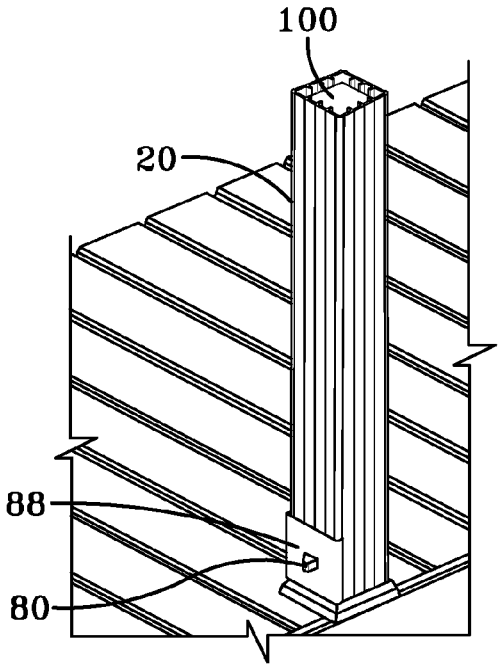
Figure 21E:
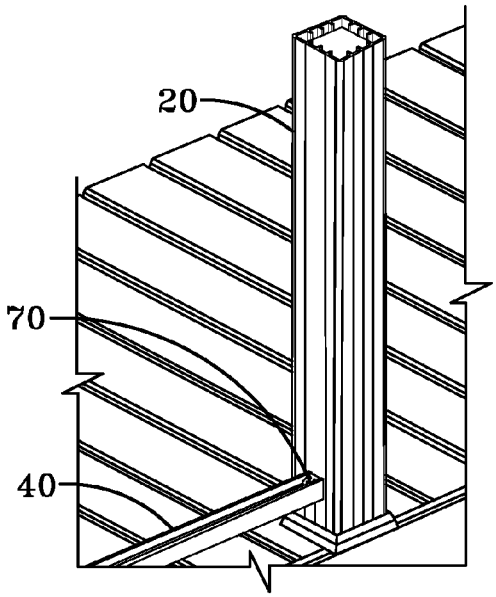
Figure 21F:
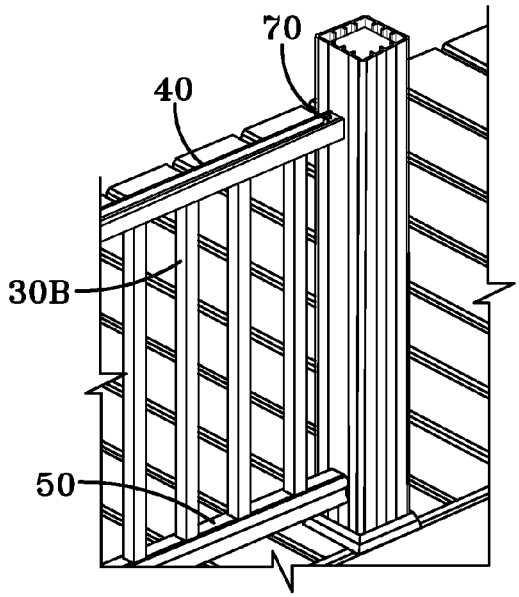
Figure 21G:
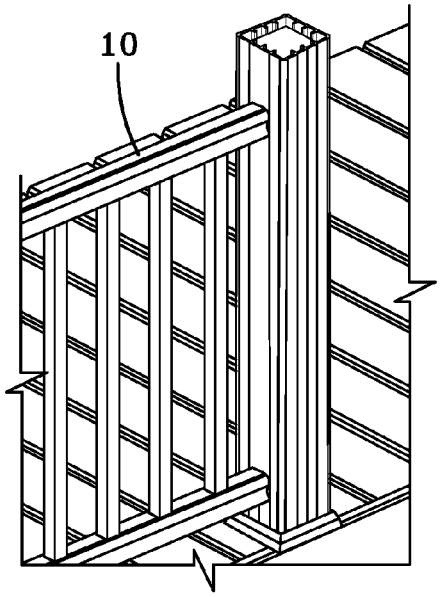
Figure 21H:
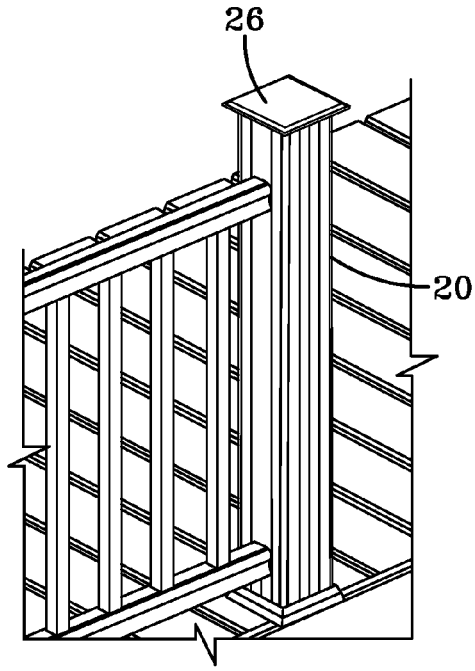

FIGS. 21A through 21H illustrate an exemplary set of sequential steps for an exemplary installation of this invention as a handrail or guard. FIG. 21A depicts an installed post 100, which may be built, for example, on the perimeter of a walkway (e.g., a residential deck). FIG. 21B illustrates the installation of a post skirt 28 around post 100. Post cover 20 is next installed over post 100 and into the post skirt 28 as shown in FIG. 21C. Support block 80 may be installed on the post cover 20 using an optional template 88 to assist with positioning, as shown in FIG. 21D. This optional template 88 may be placed on post skirt 28 or a deck to consistently position the support block 80 during installation and may be made of plastic, cardboard, metal, or any other suitable material. For convenience, it may be included as a "punch out" feature in the packaging for the railing components, or it may be supplied separately. If integrated into the packaging, it may be punched or cut out prior to or after the railing components have been removed from the packaging. In order to assist with positioning support block 80, an opening may be punched or cut out of template 88 for receiving support block 80, and the sides of template 88 may optionally be folded such that template 88 wraps around opposing sides of post cover 20. In this exemplary embodiment, support block 80 is aligned with the centerline of post cover 20 for both angled and straight sections. Furthermore, support block 80 is oriented such that the angled edge is in the desired direction. FIG. 21E shows the placement of lower support rail 40 on support block 80 (not shown). Optionally, lower support rail 40 may be pre-assembled with at least one squash block 60, which may be secured with fasteners 90. In addition, bracket 70 may be secured to lower support rail 40 prior to placing lower support rail 40 on support block 80. After placing lower support rail 40 on support block 80, fasteners 90 may be used to secure bracket 70 and lower support rail 40 to post cover 20. Alternatively, lower support rail 40 may first be placed on support block 80, and then bracket 70 may be secured to lower support rail 40 and post cover 20 with fasteners 90. FIG. 21F next illustrates the installation of a lower rail 50, balusters 30B, and upper support rail 40. In an exemplary method, balusters 30B may first be secured between upper support rail 40 and lower rail 50 to form a sub-assembly. As can be seen in FIG. 3C, lower rail 50 may optionally include a protruding edge 54, which may provide a convenient alignment surface against which to mount balusters 30B. The sub-assembly may then be installed such that the lower rail 50 is positioned over lower support rail 40. In other exemplary installation methods, balusters 30B, upper support rail 40, and lower rail 50 may be installed individually or in various sub-combinations. It should be noted that a bracket 70 is installed on the upper support rail 40 and is subsequently connected to the post cover 20 to secure the rail assembly into position. FIG. 21G illustrates the installation of the upper or handrail 10, which may simply be placed over upper support rail 40. Fasteners 90 may subsequently be used to secure upper or handrail 10 to upper support rail 40. For example, fasteners 90 may be inserted (e.g., screwed) upward through upper support rail 40 in order to engage and secure upper or handrail 10. Lastly, FIG. 21H shows the installation of a finishing post cover cap 26 onto the post cover 20 to provide a weather-resistant barrier to the elements and provide a pleasing finished look to the rail system.

Figure 22A:
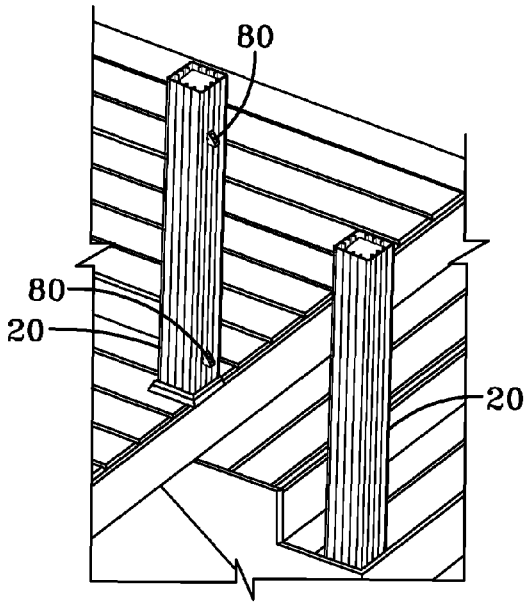
FIGS. 22A through 22D are partial perspective views illustrating a sequential step-by-step installation of an exemplary embodiment of a stair rail system.
Figure 22B:
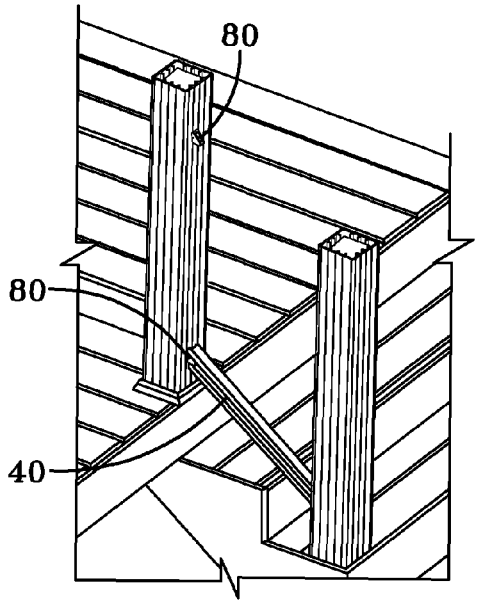
Figure 22C:
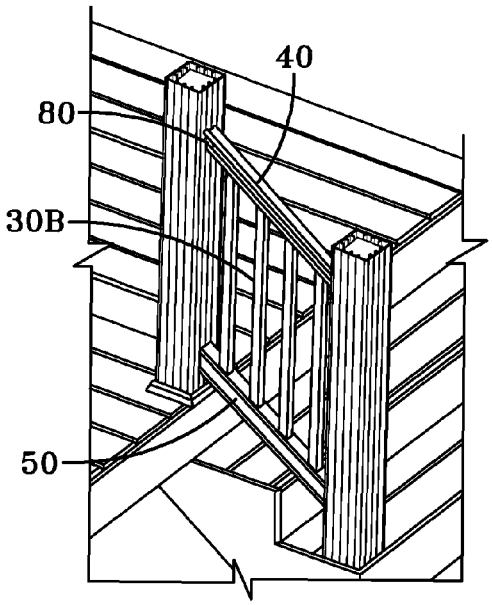
Figure 22D:
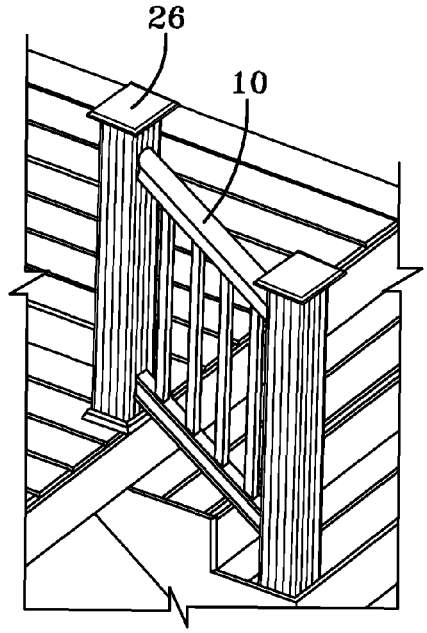
Figure 22E:
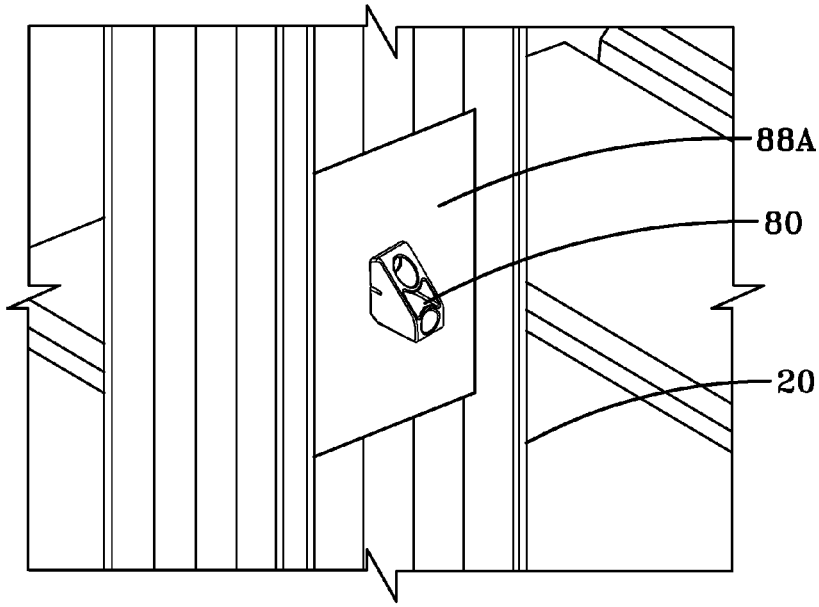
FIG. 22E is a perspective view of an exemplary embodiment of a system for installing a support block.

FIGS. 22A through 22D illustrate an exemplary set of sequential steps of an exemplary installation of this invention as a stair rail guard. FIG. 22A shows an installation of two post covers 20 and support blocks 80. As described above with regard to the handrail application, support blocks 80 may be positioned using an optional template or templates. FIG. 22B next shows an installation of a lower support rail 40, which is supported by a support block 80 on each post cover 20. Such as shown in FIG. 16 or FIG. 19, brackets 70 may be used to directly or indirectly secure lower support rail 40 to each post cover 20. In an exemplary method, brackets 70 may be secured to lower support rail 40 prior to or during installation. FIG. 22C next shows the installation of balusters 30B, lower rail 50, and upper support rail 40. Balusters 30B may be cut, mitered, or otherwise formed to have angled edges suitable for this type of application. Similar to the above-described installation of a handrail, balusters 30B may first be secured between upper support rail 40 and lower rail 50 to form a sub-assembly. The sub-assembly may then be installed such that the lower rail 50 is positioned over lower support rail 40. In other exemplary installation methods, balusters 30B, upper support rail 40, and lower rail 50 may be installed individually or in various sub-combinations. Again, it should be noted that a bracket 70 is installed on the upper support rail 40 and is subsequently directly or indirectly connected to the post cover 20 to secure the rail assembly into position. Next, FIG. 22D shows the installation of the upper or handrail 10 and post cover caps 26 to complete an exemplary stair rail assembly. Finally, FIG. 22E shows an exemplary embodiment of a template 88A, which may be used to facilitate the positioning of a support block 80 on a support structure such as, but not limited to, a post, which may include a post cover 20. In this example, template 88A may be aligned with an edge of post cover 20 to facilitate positioning. In other exemplary embodiments, a template may wrap around at least one corner of a post cover, for example, to facilitate positioning.

Figure 23:
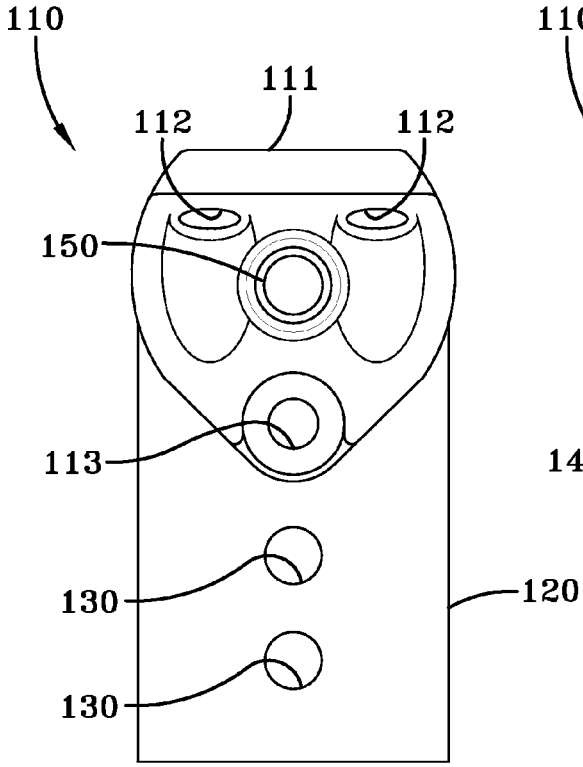
FIG. 23 illustrates a top view of another embodiment of an exemplary bracketing system.
Figure 24:
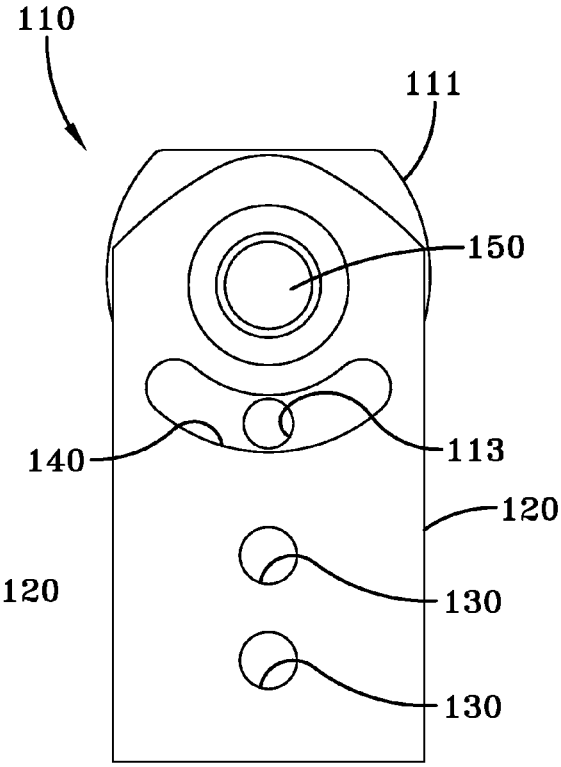
FIG. 24 illustrates a bottom view of the exemplary bracketing system of FIG. 24.

FIGS. 23 and 24 illustrate a new and improved bracketing system 110. A portion 111 may be pivotally connected to another portion (e.g., a metal plate 120) by means of any type of pivotal connection such as a rivet 150 or a male/female pivotal connection, for example. In an exemplary embodiment, the first portion 111 may move freely and smoothly around portion 120. Portion 120 may contain one or more holes 130 for the insertion of fasteners (e.g., to secure the bracketing system 110 to a rail). Furthermore, portion 111 may contain holes 112, which are preferably angled relative to the portion 120 as previously described, and an additional optional hole 113 for the insertion of fasteners. For instance, fasteners may be inserted through holes 112 to secure bracketing system 110 to a desired object including, but not limited to, a post. A fastener may be inserted through hole 113 to secure bracketing system 110 to a desired object including, but not limited to, a rail. Such as is illustrated in FIG. 24, hole 140 in portion 120 may accommodate use of a fastener in hole 113 while portion 111 is at any desired vertical or horizontal angle (e.g., up to and including a 45 degree angle in one exemplary embodiment). As a result, portion 111 may be rotated at an angle about portion 120 and thus allow for use of the bracketing system in applications requiring the use of an angled bracket. In fact, an exemplary embodiment of bracketing system 110 may be used similarly to the aforementioned embodiments of a bracket, while providing improved strength characteristics when installed due to the improved distribution of forces.

Figure 25:
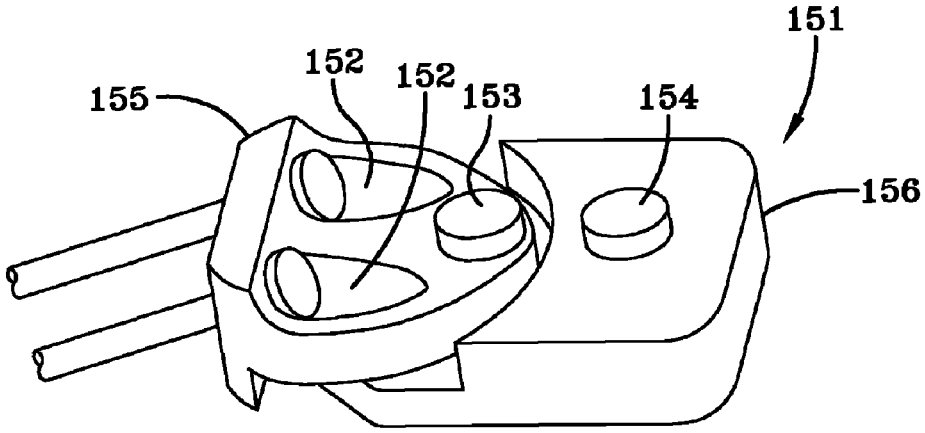
FIG. 25 is a perspective view of another embodiment of an exemplary bracketing system.
Figure 26:
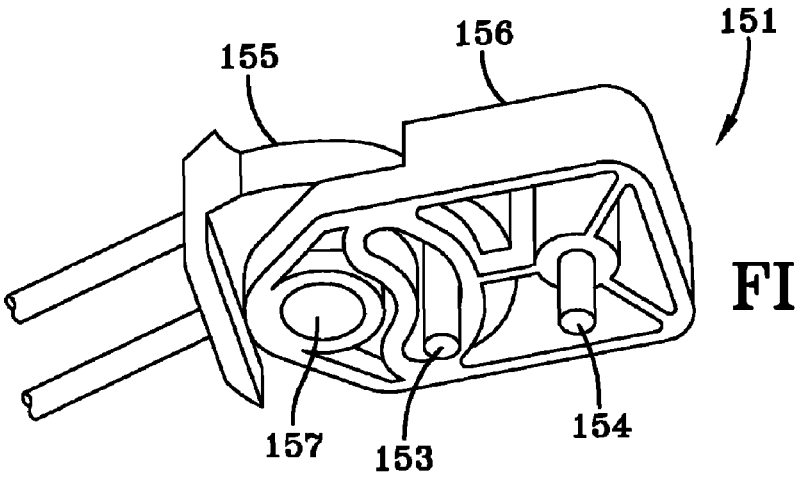
FIG. 26 is a perspective view of another embodiment of the bracketing system of FIG. 25.

FIGS. 25 and 26 show perspective views of another embodiment of a bracketing system 151. The system may employ a portion 155 that may rotate about another portion 156. Holes 152, which may be angled, may accommodate fasteners such as shown, and additional fasteners 153 and 154 may be used as well, such as described above. Fastener 153 may be inserted while portion 155 is at an angle relative to portion 156. Portion 155 may be pivotally connected to portion 156 by means of pivotal connection 157 (e.g., a male/female pivotal connection) that may allow for rotation of bracket 155 within a desired radius. Again, an exemplary embodiment of bracketing system 151 may be used similarly to the aforementioned embodiments of a bracket, while providing improved strength characteristics when installed due to the improved distribution of forces provided by the pivotal system.

Figure 27:
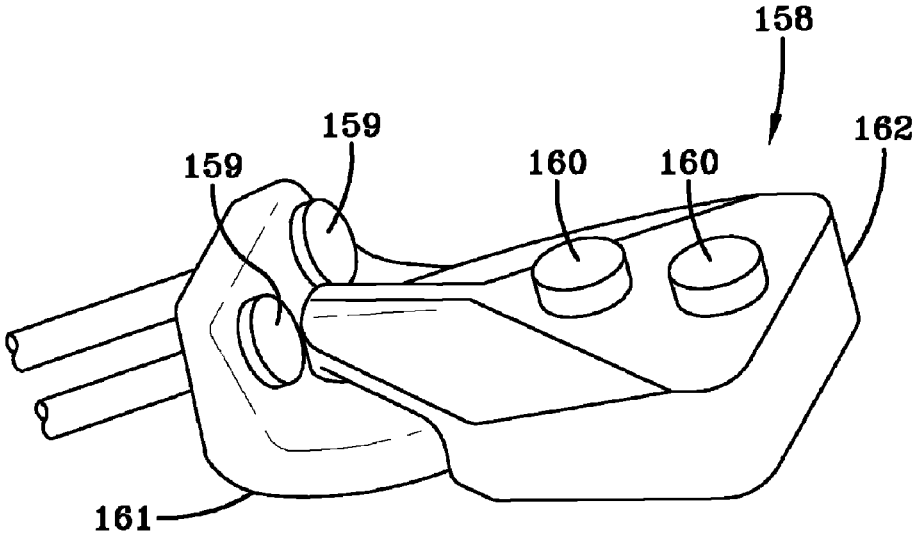
FIG. 27 is a perspective view of another embodiment of an exemplary bracketing system.

FIG. 27 shows another embodiment of a bracketing system 158 in which fasteners 159 may be inserted at an angle and fasteners 160 may be additionally employed. The bracketing system 158 may be comprised of two portions 161 and 162 so that portion 161 may rotate within a desired radius for applications which may require an angled bracket connection (e.g., a horizontal or vertical angle). Any suitable pivotal connection may be provided between portions 161 and 162. In this example, portions 161 and 162 may also facilitate improved distribution of forces when installed, thereby improving the strength characteristics of a resulting railing system, for example.

Figure 28C:
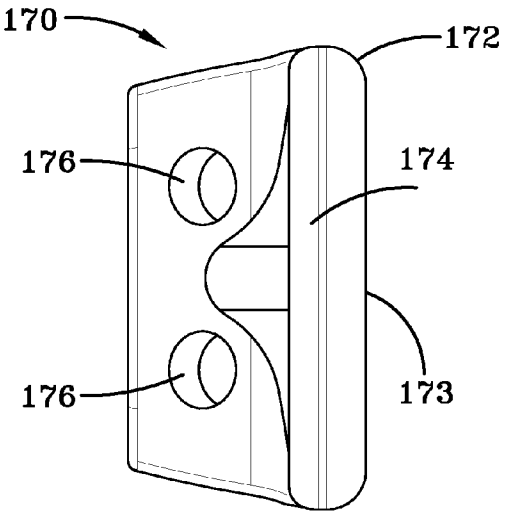
FIG. 28C is another side elevation view of the exemplary embodiment of the portion of a bracketing system of FIG. 28A.
Figure 28D:
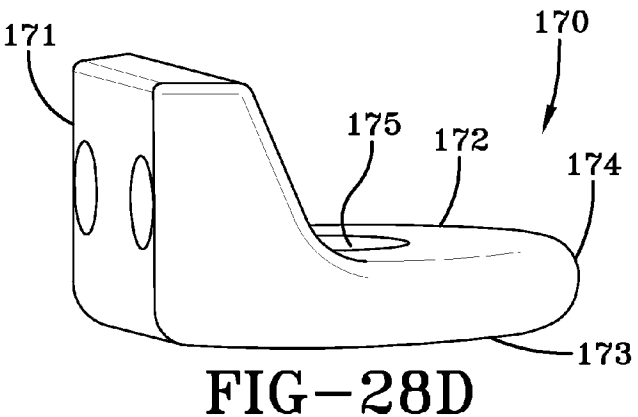
FIG. 28D is a perspective view of the exemplary embodiment of the portion of a bracketing system of FIG. 28A.
Figure 28B:
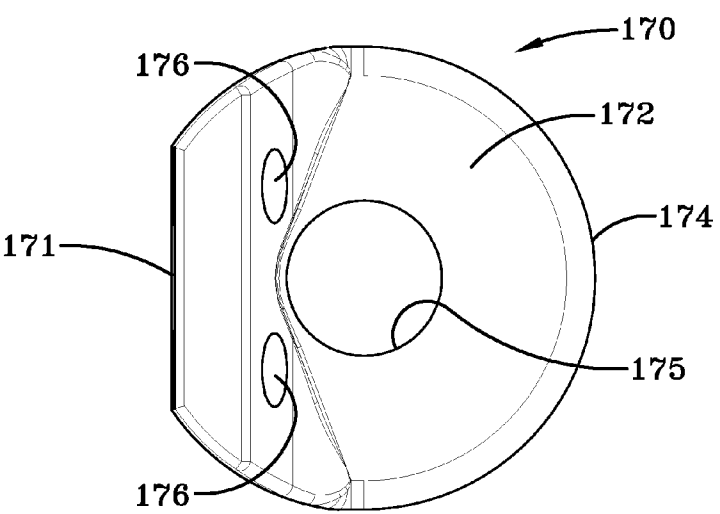
FIG. 28B is a top plan view of the exemplary embodiment of the portion of a bracketing system of FIG. 28A.
Figure 28A:
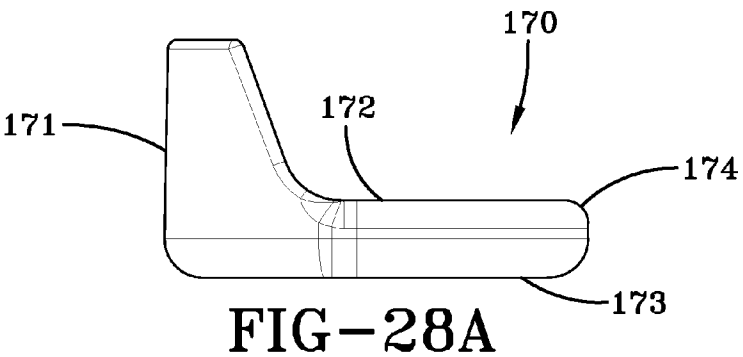
FIG. 28A is a side elevation view of an exemplary embodiment of a portion of a bracketing system.

FIGS. 28A through 28D show various views of a portion 170 of another exemplary embodiment of a bracketing system of the present invention. In this example, portion 170 may be comprised of a mounting surface 171 and a base 172. Mounting surface 171 may be in association with base 172 such that portion 170 is generally L-shaped such as shown in FIG. 28A. For example, mounting surface 171 may be substantially vertical, and a bottom surface 173 of base 172 may be substantially perpendicular to mounting surface 171. Base 172 may extend from mounting surface 171 such that a distal edge 174 of base 172 is generally curved, preferably rounded. As will be later described, curved distal edge 174 may facilitate angled installations of railing as well as a pivotal relationship with an associated portion of the bracketing system. Base 172 may include a female portion 175 that may facilitate an adjustable connection (e.g., a pivotal connection) with an associated portion of the bracketing system. For example, female portion 175 may be adapted to adjustably receive a rivet or a male portion of an associated portion of the bracketing system. In order to secure portion 170 to a desired object (e.g., a post), at least one hole may extend through mounting surface 171 for receiving a fastener. In this example, two holes 176 extend through mounting surface 171. Such as shown in FIG. 28C, mounting holes 176 preferably extend at an oblique angle in order to facilitate the insertion of fasteners.

Figure 29A:
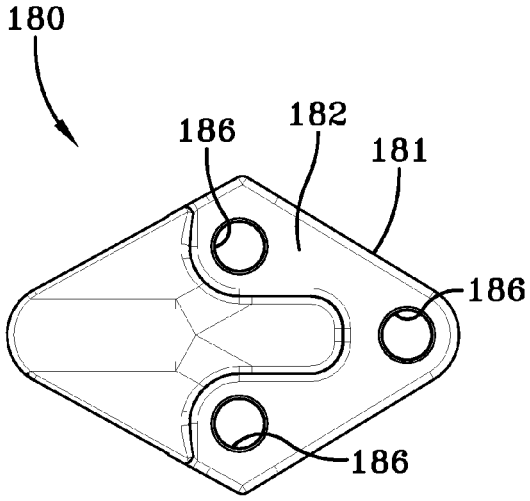
FIG. 29A is a top plan view of an exemplary embodiment of a portion of a bracketing system.
Figure 29E:
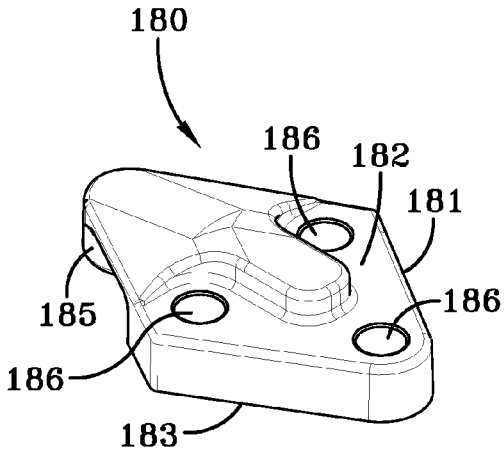
FIG. 29E is a perspective view of the exemplary embodiment of the portion of a bracketing system of FIG. 29A.
Figure 29B:
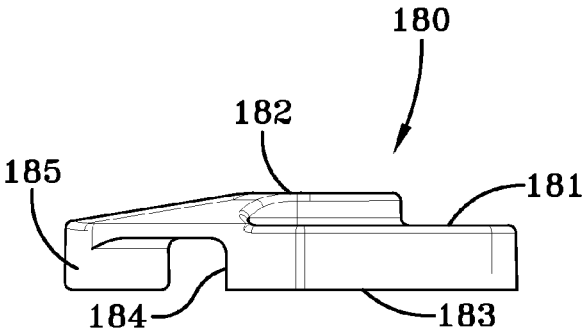
FIG. 29B is a side elevation view of the exemplary embodiment of the portion of a bracketing system of FIG. 29A.
Figure 29D:
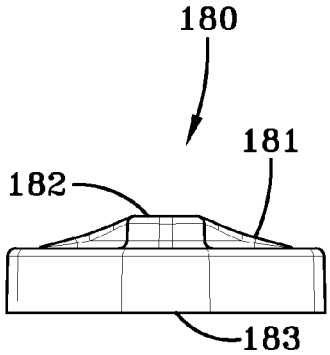
FIG. 29D is another side elevation view of the exemplary embodiment of the portion of a bracketing system of FIG. 29A.
Figure 29C:
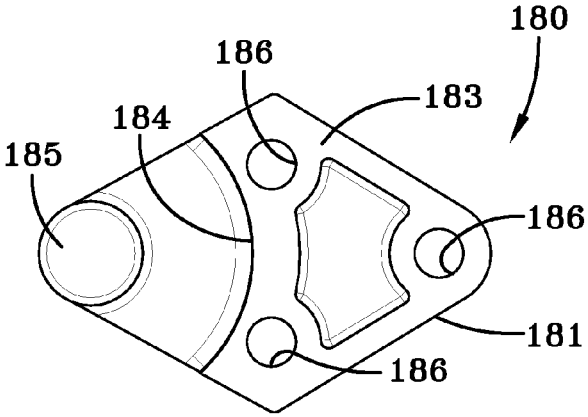
FIG. 29C is a bottom plan view of the exemplary embodiment of the portion of a bracketing system of FIG. 29A.

FIGS. 29A through 29E show an example of another portion 180 of a bracketing system that may be used in association with portion 170. Portion 180 may be adjustably, preferably pivotally, connected to portion 170. Portion 180 may be comprised of a body 181 having a top surface 182 and a bottom surface 183. When assembled, bottom surface 183 may be in substantially the same plane as the bottom surface 173 of portion 170. Body 181 may further include a side edge 184, which may be generally curved (e.g., rounded) and extend downward relative to top surface 182. As a result, when assembled, top surface 182 may extend over base 172 of portion 170, and side edge 184 may be adjacent to distal edge 174 of portion 170 such that side edge 184 is adapted to be moved (e.g., rotated) around distal edge 174 of portion 170. In this exemplary embodiment, a male portion 185 may extend downward relative to top surface 182, whereby male portion 185 is adapted to be adjustably, preferably pivotally, received in female portion 175 of portion 170. In other exemplary embodiments, it should be recognized that a rivet or any other suitable adjustable (e.g., pivotal) connection may be employed. One example of another suitable adjustable connection includes, but is not limited to, a reversed male/female connection. At least one anchor hole may extend through body 181. In particular, three anchor holes 186 extend through body 181 in this example for receiving fasteners that may secure the resulting bracketing system to a desired object, such as a rail. At least one anchor hole 186 in portion 180 may help to distribute forces experienced by a resulting bracketing system when installed. Even further distribution of the forces that may be experienced by a resulting bracketing system when installed may be achieved by providing a triangular arrangement of anchor holes 186, such as shown in FIGS. 29A, 29C, and 29E. As shown, portion 180 may be generally diamond-shaped, which may facilitate a desired arrangement of at least one anchor hole 186 for distributing forces that may be experienced by an installed bracketing system. Other suitable shapes of portion 180 may be employed including, but not limited to, rounded, curved, square, rectangular, polygonal, or any other suitable shape for the desired installation.

Figure 30A:
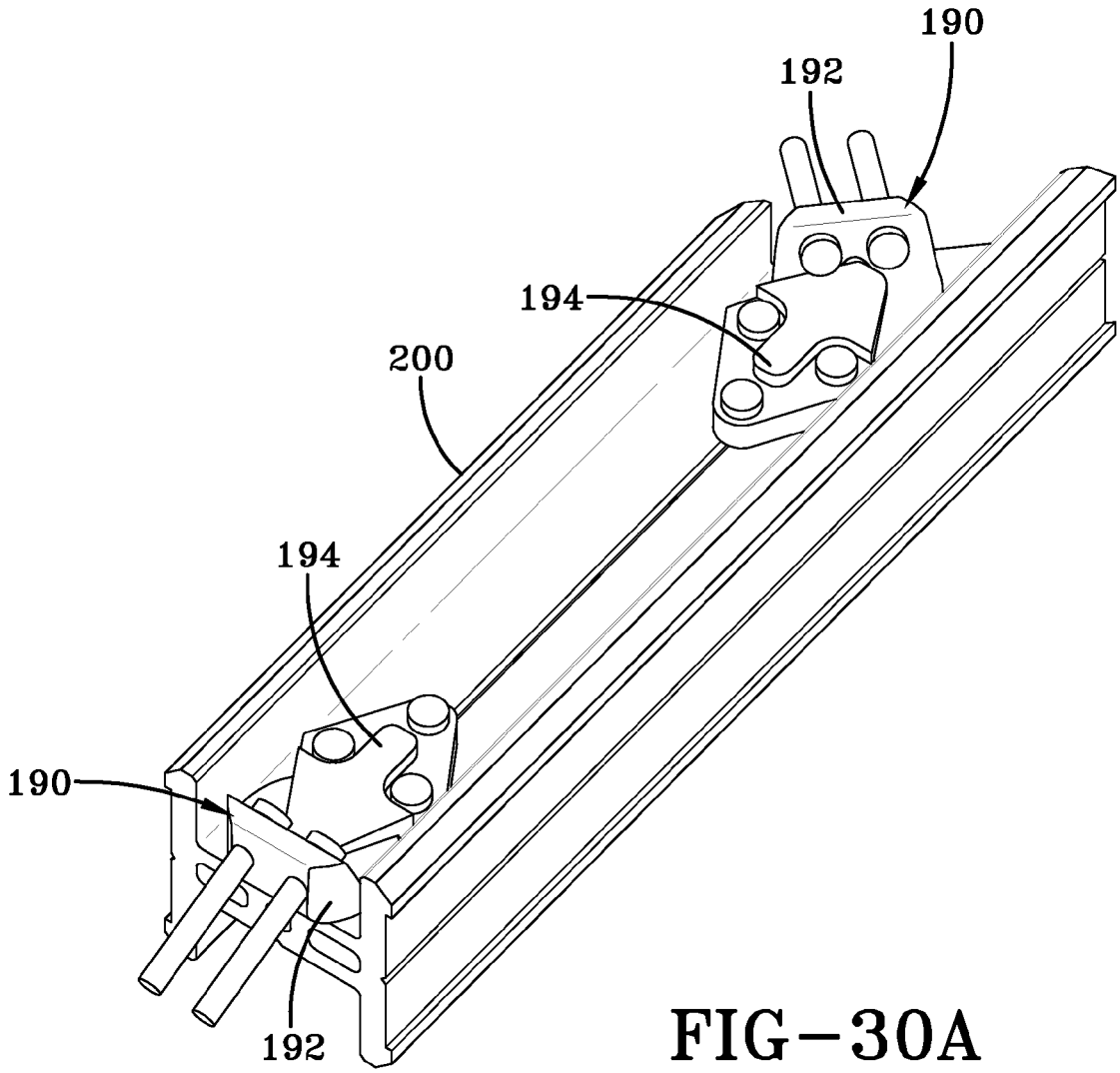
FIG. 30A is a perspective view of an exemplary installation of a bracketing system.
Figure 30B:
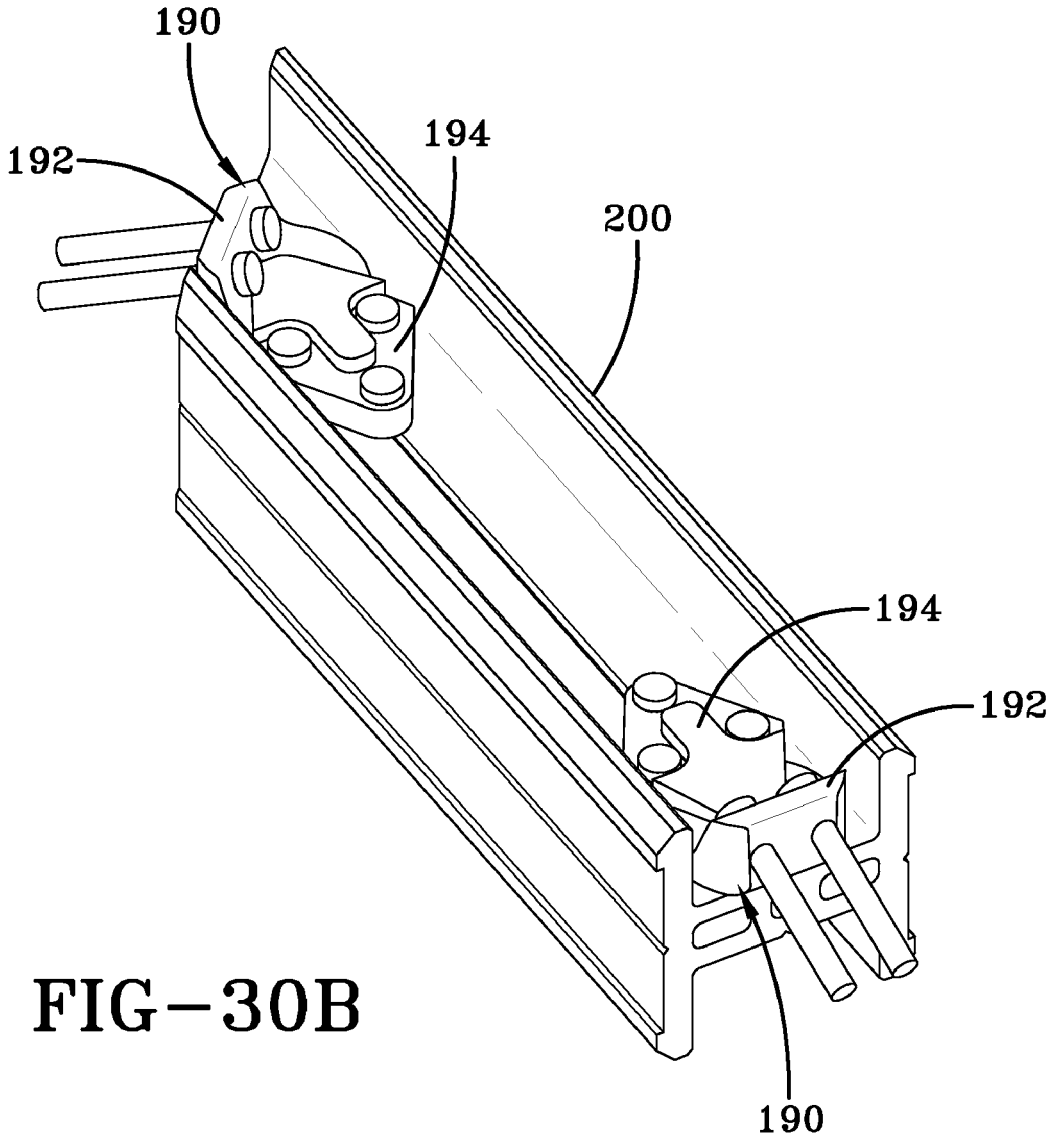
FIG. 30B is another perspective view of the exemplary installation of a bracketing system.
Figure 31B:
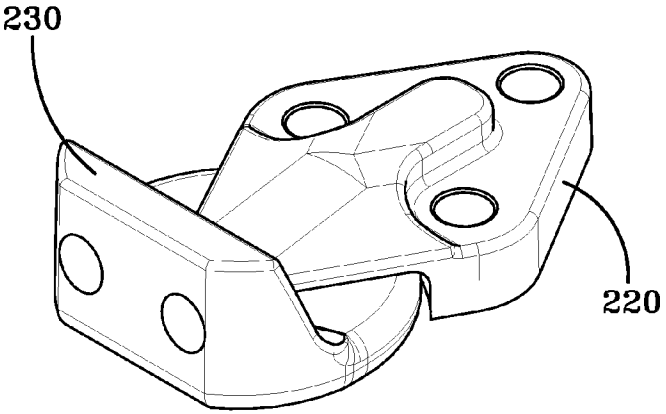
FIGS. 31A through 31D show various views of an exemplary embodiment of a bracketing system of the present invention.
Figure 31D:
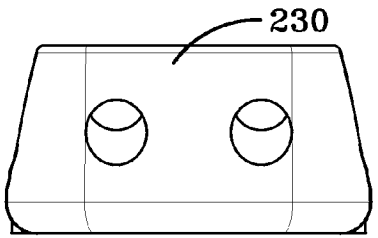
Figure 31A:
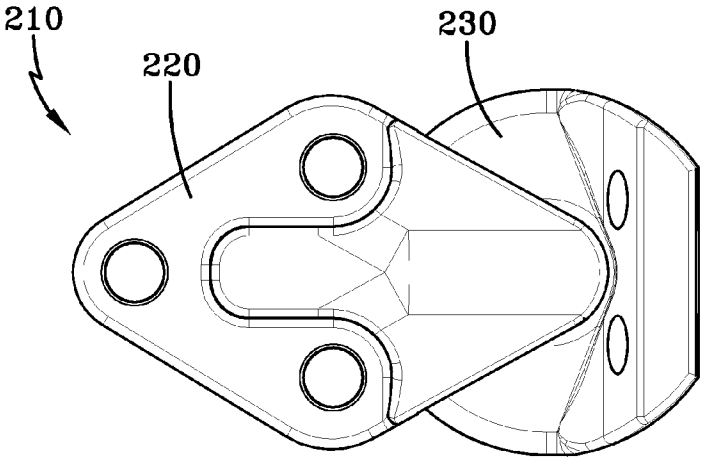
Figure 31C:
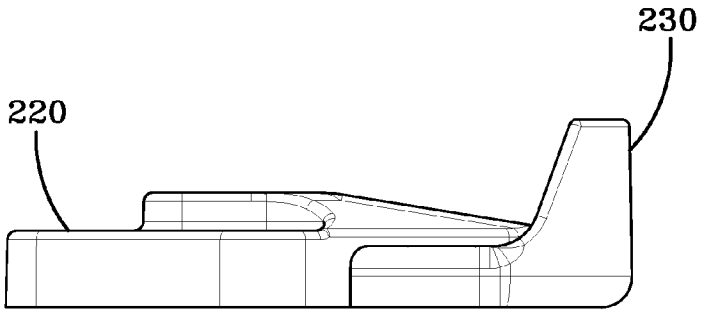
Figure 32A:
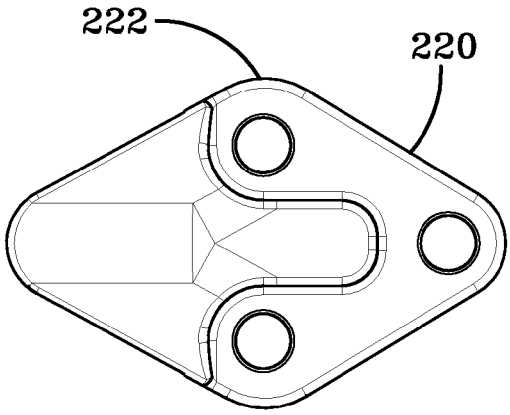
FIGS. 32A through 32E show various views of an exemplary embodiment of a portion of the bracketing system of FIGS. 31A through 31D.
Figure 32B:
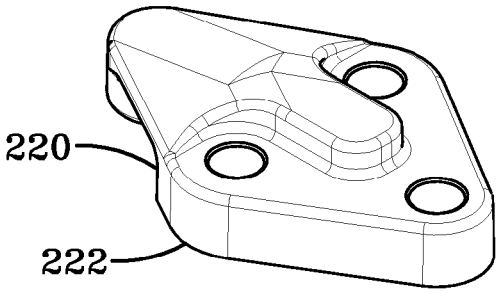
Figure 32C:
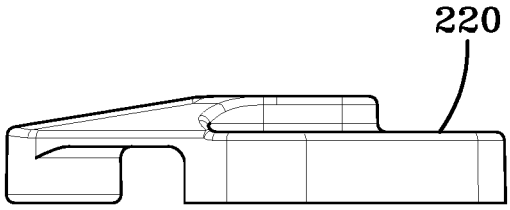
Figure 32D:
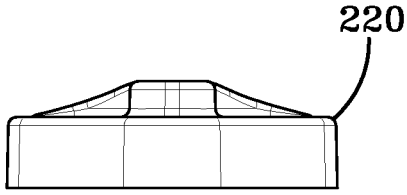
Figure 32E:
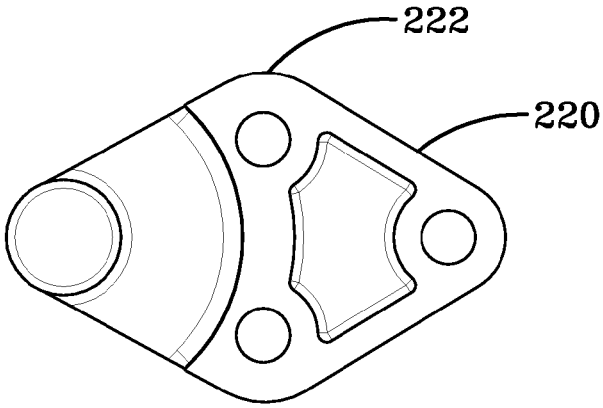

FIGS. 30A and 30B show an exemplary installation of a bracketing system that may include portions similar to the above-described portion 170 and portion 180. The example of FIGS. 30A and 30B show how an exemplary bracketing system may facilitate perpendicular or angled connections to a desired object (e.g., a post). The angled connections may be at horizontal or vertical angles, as desired. In this exemplary embodiment, each bracketing system 190 is secured to a rail 200 (e.g., a support rail). As shown, each bracketing system 190 is comprised of a portion 192 and a portion 194. In this exemplary embodiment, as a result of the adjustable relationship between portion 192 and portion 194, portion 192 may be generally square with the object (e.g., a post) to which it is desired to connect rail 200 regardless of the angle of the connection, whereas portion 194 may be generally aligned with rail 200 regardless of the angle of the connection. Such a configuration may improve the distribution of forces that may be experienced by an installed bracketing system, thereby improving the strength characteristics of a resulting railing system, for example.

Figure 33B:
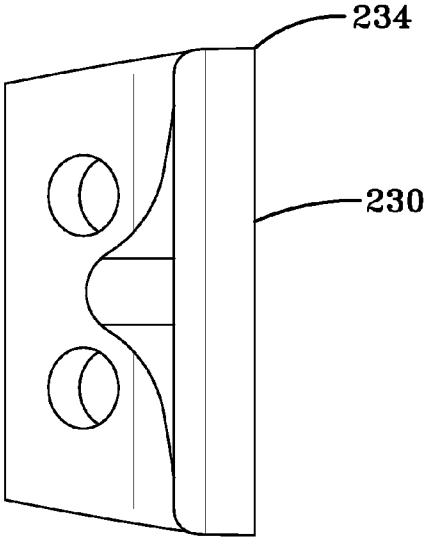
FIGS. 33A through 33C show various views of an exemplary embodiment of another portion of the bracketing system of FIGS. 31A through 31D.
Figure 33A:
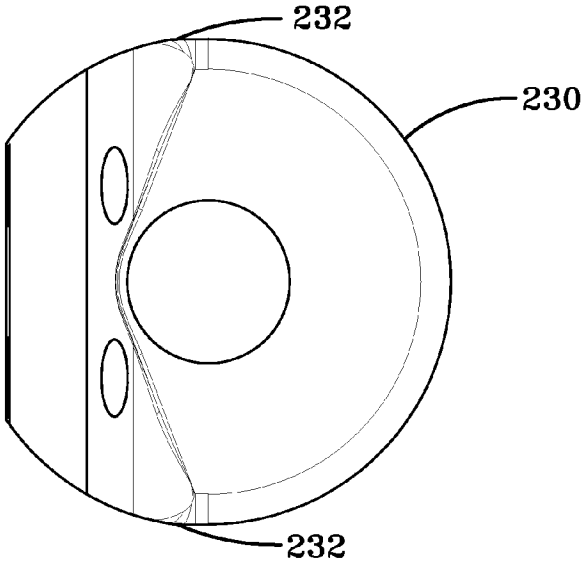
Figure 33C:
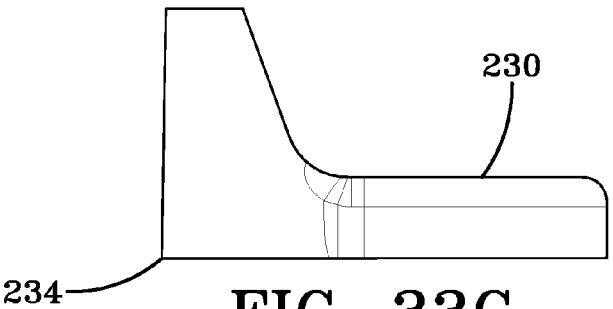

FIGS. 31A through 31D show another example of a bracketing system, which may be similar to the bracketing system shown in FIGS. 30A and 30B. In this example, bracketing system 210 is comprised of a portion 220 that is adjustably (e.g., pivotally) connected to a portion 230. As shown in FIGS. 32A through 32E, portion 220 may be similar to portion 180 of FIGS. 29A through 29E, with the exception being that portion 220 has rounded corner portions 222. Rounded corner portions 222 may provide improved distribution of forces, particularly in the event that a rounded corner portion 222 comes into contact with a railing component when installed. In such situations, rounded corner portion 222 may limit the stress on the railing portion, thereby limiting damage to the railing portion. Nevertheless, it should be recognized that it may be preferred in some installations that rounded corner portions 222 promote clearance from an associated railing component when installed such that rounded corner portions 222 do not come into contact with the railing component. Somewhat similarly, portion 230 may have generally rounded sides 232 as shown in FIGS. 33A through 33C. Rounded sides 232 may also provide improved distribution of forces in the event that a rounded side 232 comes into contact with a railing component when installed. However, it should again be recognized that it may be preferred in some installations that rounded sides 232 promote clearance from an associated railing component when installed such that rounded sides 232 do not come into contact with the railing component. Optionally, as shown in FIGS. 33B and 33C, portion 230 may have a substantially square bottom edge 234, as compared to the rounded bottom edge of potion 170 shown in FIGS. 28A through 28C. Otherwise, the exemplary embodiment of portion 230 may be substantially similar to the exemplary embodiment of portion 170.

The aforementioned bracketing systems may be comprised of any suitable materials. Examples of materials include, but are not limited to, metals and plastics and other similar or suitable materials. One example of a metal is die cast aluminum or zinc alloy, and one example of a plastic is a nylon alloy, such as DUPONT ZYTEL nylon alloy, which may provide desirable flexible or elastic properties for some installations for handling stresses. Other similar or suitable metals and plastics may also be used.

The immediately preceding examples of bracketing systems may be capable of pivotal movement. Nevertheless, other types of adjustment are also possible. For instance, in one exemplary embodiment, the portions of a bracketing system may be adapted to be separated and then secured together (e.g., snapped together) in any desired angular position. In other exemplary embodiments, the portions of an exemplary bracketing system may be self-retaining.

Referring again to the other railing components, a component of an exemplary embodiment of the present invention may be made from any suitable materials, unless expressly claimed otherwise. Although many materials may be used to fabricate the components disclosed herein, one exemplary embodiment may employ composite material that may be resistant to weathering and easily integrated into structures, such as railing. In one exemplary embodiment, a capstock layer (e.g., a PVC capstock layer) may be placed over a composite substrate to form an upper or handrail 10, support rail 40, bottom rail 50, squash blocks 60, balusters 30A or 30B, post covers 20, and ancillary components, such as post skirts 28 and caps 26, thereby providing a system of components that may be easily assembled into a rail. The capstock layer may be comprised of PVC, which may be placed over the composite substrate by any suitable fabrication method, such as co-extrusion, compression molding, injection molding, or other similar or suitable methods. The capstock layer and base material combination may allow lower cost, less attractive, and structurally rigid materials to be used as a base framework upon which an attractive and protective PVC capstock layer may be applied. Nevertheless, it should be recognized that other suitable materials may be used such as, but not limited to, wood, metal, composites, plastics, and other similar or suitable materials.

In one exemplary embodiment of the present invention, a substrate may be comprised of a composite that has a high cellulosic content. In particular, the composite may be comprised of cellulosic material in the amount of at least about 50% by weight and a plastic material in an amount of up to about 50% by weight. For instance, in one exemplary embodiment, the composite may be comprised of cellulosic material in the amount of about 55% by weight and a plastic material in an amount of about 45% by weight. In yet another exemplary embodiment, the composite may be comprised of cellulosic material in the amount of about 60% by weight and a plastic material in an amount of about 40% by weight.

The high cellulosic content enables the cost-effective production of a substrate that has desirable structural characteristics. For example, the high cellulosic content promotes the desired durability, rigidity, flexibility, and other structural characteristics for a variety of types of components. For instance, the high cellulosic content may enable the cost-effective production of railing components that exceed load testing requirements.

The cellulosic material may be virgin or recycled. Examples of cellulosic material include sawdust, newspapers, alfalfa, wheat pulp, wood chips, wood fibers, wood particles, ground wood, wood flour, flax, wood flakes, wood veneers, wood laminates, paper, cardboard, straw, cotton, rice hulls, coconut shells, peanut shells, bagasse, plant fibers, bamboo fiber, palm fiber, kenaf, and other similar, suitable, or conventional materials. Any of the wood examples may be hard or soft wood or variations thereof. Furthermore, any desired mesh size of the cellulosic material can be used. With regard to wood flour, an exemplary range of mesh size is about 10 to about 100 mesh, more preferably about 20 mesh to about 80 mesh depending on the desired characteristics of the composite.

The cellulosic material may be dried to a desired moisture content prior to or during the formation of the base layer. For example, the cellulosic filler(s) may be dried to about 0.5% to about 3% moisture content by weight, more preferably to about 1% to about 2% moisture content by weight. However, it should be recognized that the cellulosic material may have a moisture content less than about 0.5% by weight or greater than about 3% by weight and still be within the scope of the present invention.

The plastic material may be comprised of virgin or recycled materials that may improve the characteristics of the reinforced composite and/or enhance the manufacture or moldability thereof. In an exemplary embodiment of the present invention, the plastic material is a PVC material, which enables the production of a component having structural characteristics suitable for railing or other structurally demanding applications. The PVC material may, for example, be made by mixing PVC resin with, optionally, at least one stabilizer, at least one lubricant, at least one process aid, and other optional ingredients (e.g., acrylic modifier, inorganic filler, and other suitable additives). Optionally, another plastic resin may also be included in the composite such as, but not limited to, acrylonitrile butadiene styrene (i.e., ABS) resin. An example of a mixer is a high intensity mixer such as those made by Littleford Day Inc. or Henschel Mixers America Inc. As an example, the mechanically induced friction may heat the ingredients to a temperature between about 200° F. and about 230° F. After mixing, the ingredients may be cooled to ambient temperature. Alternatively, the ingredients of the PVC material may be mixed together during the formation of the base layer.

With reference to a plastic material that comprises PVC resin, the plastic material may include stabilizer(s) in an amount of about 1 to about 10 parts, more preferably about 2 to about 4 parts, per 100 parts of the PVC resin. The lubricant (s) may be present in an amount of about 2 to about 12 parts, more preferably about 4 to about 11 parts, per 100 parts of the PVC resin. Also, process aid(s) may be included in an amount of about 0.5 to about 8 parts, more preferably about 0.7 to about 3 parts, per 100 parts of the PVC resin. Optionally, acrylic modifier(s) (e.g., impact modifiers) may be present in an amount of about 1 to about 10 parts, more preferably about 4 to about 8 parts, per 100 parts of the PVC resin. As a further option, inorganic filler(s) may be added in an amount of up to about 10 parts, more preferably about 3 to about 9 parts, per 100 parts of the PVC resin. In addition, another plastic resin (e.g., ABS resin or any other similar or suitable resin) may be included in an amount up to about 50% by weight of the composite, more preferably about 5-10% by weight of the composite.

Stabilizer(s) may be employed to limit or prevent the breakdown of the plastic material during molding. Examples of stabilizers include tin stabilizers, lead and metal soaps such as barium, cadmium, and zinc, and other similar or suitable materials.

Internal or external lubricant(s) may aid in the molding process. Lubricants may be added to the plastic material to assist the reinforced composite through an extruder, compounder, or other molding machine, and to help facilitate mold release. Examples of lubricants include zinc stearate, calcium stearate, esters, amide wax, paraffin wax, ethylene bis-stearamide, and other similar or suitable materials.

Process aid(s) may aid in the fusion of the compound. Examples of process aids include acrylic process aids and other similar or suitable materials for improving the fusion of the compound. R&H K-120N and R&H K-175 are examples of acrylic process aids that are available from Rohm & Haas.

Acrylic modifier(s) may improve the physical characteristics of the compound. One example of an impact modifier is Arkema P530. Another example of an acrylic modifier is R&H K-400, which is available from Rohm & Haas. Although R&H K-400 is a high molecular weight acrylic modifier that is specifically designed for PVC foam applications, the inventors have discovered that it may also improve the physical characteristics of the base layer of the present invention, which has a high cellulosic content and may not include any foaming or blowing agents.

Inorganic filler(s) may be used to increase the bulk density of the reinforced composite. The use of inorganic filler may also improve the ability to process the reinforced composite, thereby allowing for higher rates of manufacture (e.g., extrusion). Inorganic filler may also allow the reinforced composite to be molded into articles having reduced moisture sensitivity and reduced flame and smoke spread. Examples of inorganic fillers include talc, calcium carbonate, kaolin clay, magnesium oxide, titanium dioxide, silica, mica, barium sulfate, wollastanite, acrylics, and other similar or suitable materials.

Other optional ingredients that may be included in the PVC material include, but are not limited to, polymers, plastics, thermoplastics, rubber, cross-linking agents, accelerators, inhibitors, enhancers, blowing agents/foaming agents, compatibilizers, thermosetting materials, pigments, weathering additives, and other similar or suitable materials.

Blowing agent(s) may be used to reduce the cost (e.g., by reducing the amount of polymer used in the composite) and weight of the composite material. A blowing agent may be an endothermic or exothermic blowing agent. An example of a chemical endothermic blowing agent is Hydrocerol BIH (i.e., sodium bicarbonate/citric acid), which is available from Clariant Corp., whereas an example of a chemical exothermic foaming agent is azodicarbonamide, which is available from Uniroyal Chemical Co.

The use of thermosetting materials may, for example, reduce moisture absorption and increase the strength of products manufactured from the reinforced composite material. Examples of thermosetting materials include polyurethanes (e.g., isocyanates), phenolic resins, unsaturated polyesters, epoxy resins, and other similar or suitable materials. Combinations of the aforementioned materials are also examples of thermosetting materials.

Pigments may be used to give the composite a desired color (e.g., white, cedar, gray, and redwood). Examples of pigments include titanium dioxide, iron oxide, and other similar or suitable colorant additives.

Titanium dioxide is also an example of a weathering additive. Other similar or suitable weathering additives include, but are not limited to, other ultraviolet absorbers. Examples of other ultraviolet absorbers include organic chemical agents such as benzophenone and benzotriazole types.

Due to the high cellulosic content of some exemplary embodiments, a base layer may not provide the desired aesthetic characteristics. As a result, the present invention may provide a capstock layer on the base layer. The capstock layer is preferably comprised of PVC. The use of a capstock layer may enable lower cost, less attractive, yet structurally desirable materials that have a high cellulosic content to be used as the base framework. For instance, the capstock layer may be applied on the base layer to provide an attractive and protective finish for the component. For example, the capstock layer may be provided in any desired color (e.g., to match the appearance of a deck or building exterior), and it may have a smooth outer surface or a pattern or texture formed on its outer surface.

FIGS. 1 and 2 show examples in which a capstock layer covers the entire exterior surface of the profile. If desired, a capstock layer may also be applied on the interior surface of the profile. It should also be recognized that a capstock layer may only cover a limited portion of the interior or exterior surface of the base layer in certain embodiments of the present invention. Furthermore, some examples may not include a capstock layer.

A component of the present invention may be manufactured using any suitable manufacturing techniques. For example, a base layer and a capstock layer of a railing component may be co-extruded. Alternatively, the capstock layer may be applied on the base layer (or vice versa) in a sequential extrusion process. Other molding techniques including, but not limited to, injection molding and compression molding may be used to manufacture a component of the present invention. In addition, it should be recognized that the optional layers of a railing component may be formed separately and then joined then in a subsequent process, such as with the use of adhesives or other suitable bonding materials.

Examples

One example of a composite that may be used to make a component comprises ingredients in the following amounts:

| INGREDIENT | PARTS PER 100 PARTS OF RESIN | WEIGHT PERCENT |
|---|---|---|
| wood flour | 150 | 55.1 |
| PVC resin | 100 | 36.8 |
| lubricant | 7.5 | 2.8 |
| acrylic modifier | 6 | 2.2 |
| calcium carbonate | 5 | 1.8 |
| tin stabilizer | 2.5 | 0.9 |
| process aid | 1 | 0.4 |

Another example of a composite that may be used to make a component comprises ingredients in the following amounts:

| INGREDIENT | PARTS PER 100 PARTS OF RESIN | WEIGHT PERCENT |
|---|---|---|
| wood flour | 183 | 60 |
| PVC resin | 100 | 32.8 |
| lubricant | 7.5 | 2.5 |
| acrylic modifier | 6 | 2 |
| calcium carbonate | 5 | 1.6 |
| tin stabilizer | 2.5 | 0.8 |
| process aid | 1 | 0.3 |

A third example of a composite that may be used to make a component comprises ingredients in the following amounts:

| INGREDIENT | PARTS PER 100 PARTS OF RESIN | WEIGHT PERCENT |
|---|---|---|
| wood flour | 146.6 | 50.0 |
| PVC resin | 100 | 34.1 |
| ABS resin | 18.4 | 6.3 |
| thermal stabilizer | 3.75 | 1.3 |
| lubricant | 10 | 3.4 |
| impact modifier | 6.0 | 2.1 |
| process aid | 1 | 0.3 |
| calcium carbonate | 7.5 | 2.6 |

A fourth example of a composite that may be used to make a component comprises ingredients in the following amounts:

| INGREDIENT | PARTS PER 100 PARTS OF RESIN | WEIGHT PERCENT |
|---|---|---|
| wood flour | 179.3 | 55.0 |
| PVC resin | 100 | 30.7 |
| ABS resin | 18.4 | 5.7 |
| thermal stabilizer | 3.75 | 1.2 |
| lubricant | 10 | 3.1 |
| impact modifier | 6.0 | 1.8 |
| process aid | 1 | 0.3 |
| calcium carbonate | 7.5 | 2.3 |

A fifth example of a composite that may be used to make a component comprises ingredients in the following amounts:

| INGREDIENT | PARTS PER 100 PARTS OF RESIN | WEIGHT PERCENT |
|---|---|---|
| wood flour | 220 | 60.0 |
| PVC resin | 100 | 27.3 |
| ABS resin | 18.4 | 5.0 |
| thermal stabilizer | 3.75 | 1.0 |
| lubricant | 10 | 2.7 |
| impact modifier | 6.0 | 1.6 |
| process aid | 1 | 0.3 |
| calcium carbonate | 7.5 | 2.1 |

While specific examples of materials may be given for making the components of the present invention, it should again be recognized that the present invention is not limited to the use of any particular materials unless expressly claimed otherwise.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A bracket comprising:

a first portion comprising:

a mounting surface; and a base in association with said mounting surface such that said base of said first portion extends from said mounting surface and has a distal edge that is generally curved; and a second portion adjustably connected to said first portion, said second portion including a body having a side edge that is generally curved and adjacent to said distal edge of said base of said first portion;

wherein said side edge of said body of said second portion is adapted to be moved around said distal edge of said base of said first portion.

2. The bracket of claim 1 wherein said mounting surface is substantially vertical.

3. The bracket of claim 1 wherein said base has a bottom surface that is substantially perpendicular to said mounting surface.

4. The bracket of claim 3 wherein a body of said second portion has a bottom surface that is substantially in a same plane as said bottom surface of said base of said first portion.

5. The bracket of claim 1 wherein said first portion is generally L-shaped.

6. The bracket of claim 1 wherein said base comprises a female portion adjustably receiving said second portion.

7. The bracket of claim 1 wherein said second portion extends over said first portion.

8. The bracket of claim 1 wherein said second portion is generally diamond-shaped.

9. The bracket of claim 1 wherein said second portion comprises:

a body having a top surface; and a male portion extending downward relative to said top surface of said body;

wherein said male portion adjustably connects said second portion to said first portion.

10. The bracket of claim 1 wherein said first portion is pivotally connected to said second portion.

11. The bracket of claim 1 further comprising at least one mounting hole extending through said mounting surface of said first portion.

12. The bracket of claim 1 further comprising at least one anchor hole extending through a body of said second portion.

13. The bracket of claim 12 wherein:

three of said anchor holes extend through said body; and said anchor holes are arranged in a triangular shape.

14. A bracket comprising:

a first portion comprising:

a mounting surface;

at least one mounting hole extending through said mounting surface; and a base in association with said mounting surface, said base having a bottom surface that is substantially perpendicular to said mounting surface, said base extending from said mounting surface and having a distal edge; and a second portion pivotally connected to said first portion, said second portion comprising:

a body having a bottom surface that is substantially in a same plane as said bottom surface of said base of said first portion and a side edge adjacent to said distal edge of said base of said first portion; and at least one anchor hole extending through said body;

wherein said side edge of said body of said second portion is adapted to be rotated around said distal edge of said base of said first portion.

15. The bracket of claim 14 wherein said second portion extends over said first portion.

16. A bracket comprising:

a first portion comprising:

a mounting surface; and a base in association with said mounting surface, said base extending from said mounting surface and having a distal edge; and a second portion pivotally connected to said first portion, said second portion comprising a body having a top surface and a side edge extending downward relative to said top surface such that said top surface extends over said base of said first portion and said side edge is adjacent to said distal edge of said base of said first portion such that said side edge is adapted to be rotated around said distal edge of said base of said first portion.

17. The bracket of claim 16 further comprising:

at least one mounting hole extending through said mounting surface of said first portion; and at least one anchor hole extending through said body of said second portion.

* * * * *